US012778195B2

(12) United States Patent
Lee et al.

(10) Patent No.: US 12,778,195 B2
(45) Date of Patent: Nov. 3, 2026

(54) AEROSOL-GENERATING DEVICE

(71) Applicant: KT&G CORPORATION, Daejeon (KR)

(72) Inventors: Jongsub Lee, Sungnam-si (KR); Minkyu Kim, Seoul (KR); Jueon Park, Seoul (KR); Byungsung Cho, Gwangmyung-si (KR)

(73) Assignee: KT&G CORPORATION, Daejeon (KR)

( * ) Notice: Subject to any disclaimer, the term of this patent is extended or adjusted under 35 U.S.C. 154(b) by 502 days.

(21) Appl. No.: 18/284,730

(22) PCT Filed: Apr. 28, 2022

(86) PCT No.: PCT/KR2022/006099
§ 371 (c)(1),
(2) Date: Sep. 28, 2023

(87) PCT Pub. No.: WO2022/231343
PCT Pub. Date: Nov. 3, 2022

(65) Prior Publication Data

US 2024/0180244 A1 Jun. 6, 2024

(30) Foreign Application Priority Data

Apr. 29, 2021 (KR) ..... 10-2021-0055892

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/20* (2020.01); *A24F 40/30* (2020.01); *A24F 40/44* (2020.01)

(58) Field of Classification Search
CPC ..... A24F 40/30; A24F 40/20; A24F 40/10; A24F 40/42
See application file for complete search history.

(56) References Cited

U.S. PATENT DOCUMENTS 3,646,944 A * 3/1972 Banoczi ..... A24F 13/02 131/229
2009/0165807 A1 7/2009 Doroff
(Continued)

FOREIGN PATENT DOCUMENTS

CN 107752130 A 3/2018
CN 207836767 U 9/2018
(Continued)

OTHER PUBLICATIONS

European Search Report dated Feb. 10, 2025, on European Patent appl. No. 22796175.2.
(Continued)

*Primary Examiner* — Alex B Efta
(74) *Attorney, Agent, or Firm* — Foley & Lardner LLP

(57) ABSTRACT

An aerosol-generating device is disclosed. The aerosol-generating device of the disclosure includes a body; a cartridge coupled to the body, the cartridge comprising a first chamber configured to store a liquid and an insertion space formed separately from the first chamber and opened to an outside; and a cover configured to move between an open position and a closed position to open and close the insertion space, wherein the cartridge comprises: a cover recess formed adjacent to the opening of the insertion space, wherein the cover recess is recessed outward from the insertion space, wherein the cover is located in the cover recess when the cover is in the open position.

19 Claims, 30 Drawing Sheets

(51) Int. Cl.

| | |
|---|---|
| ***A24F 40/20*** | (2020.01) |
| ***A24F 40/30*** | (2020.01) |
| ***A24F 40/44*** | (2020.01) |

(56) References Cited

U.S. PATENT DOCUMENTS

| | | | | |
|---|---|---|---|---|
| 2012/0168329 | A1 | 7/2012 | Berggren | |
| 2012/0211014 | A1 | 8/2012 | Bardelli | |
| 2014/0345635 | A1* | 11/2014 | Rabinowitz | A24B 15/167 131/352 |
| 2020/0000146 | A1* | 1/2020 | Anderson | A24F 40/90 |
| 2020/0154766 | A1 | 5/2020 | Jeong | |
| 2020/0345066 | A1 | 11/2020 | Kim et al. | |
| 2020/0359682 | A1 | 11/2020 | Han et al. | |

FOREIGN PATENT DOCUMENTS

| | | | | |
|---|---|---|---|---|
| CN | 210726682 | U | 6/2020 | |
| CN | 111712150 | A | 9/2020 | |
| CN | 115334918 | A | 11/2022 | |
| KR | 10-2020-0030878 | | 3/2020 | |
| KR | 10-2114101 | | 6/2020 | |
| KR | 10-2020-0124674 | | 11/2020 | |
| WO | 2015165081 | | 11/2015 | |
| WO | WO-2018112766 | A1 * | 6/2018 | A24F 40/10 |
| WO | WO-2019/080746 | | 5/2019 | |
| WO | WO-2019080746 | A1 * | 5/2019 | A24F 40/60 |
| WO | 2019170893 | | 9/2019 | |
| WO | WO-2021/071203 | A1 | 4/2021 | |
| WO | WO-2022/169314 | | 8/2022 | |

OTHER PUBLICATIONS

Korean Notice of Allowance dated Apr. 25, 2023, on Korean Patent appl. No. 10-2021-0055892.

PCT International Application No. PCT/KR2022/006099, International Search Report dated Aug. 18, 2022, 2 pages.

Chinese Office Action dated Mar. 14, 2026, on Chinese Patent Appl. No. 202280028211.9.

* cited by examiner

【FIG. 1】
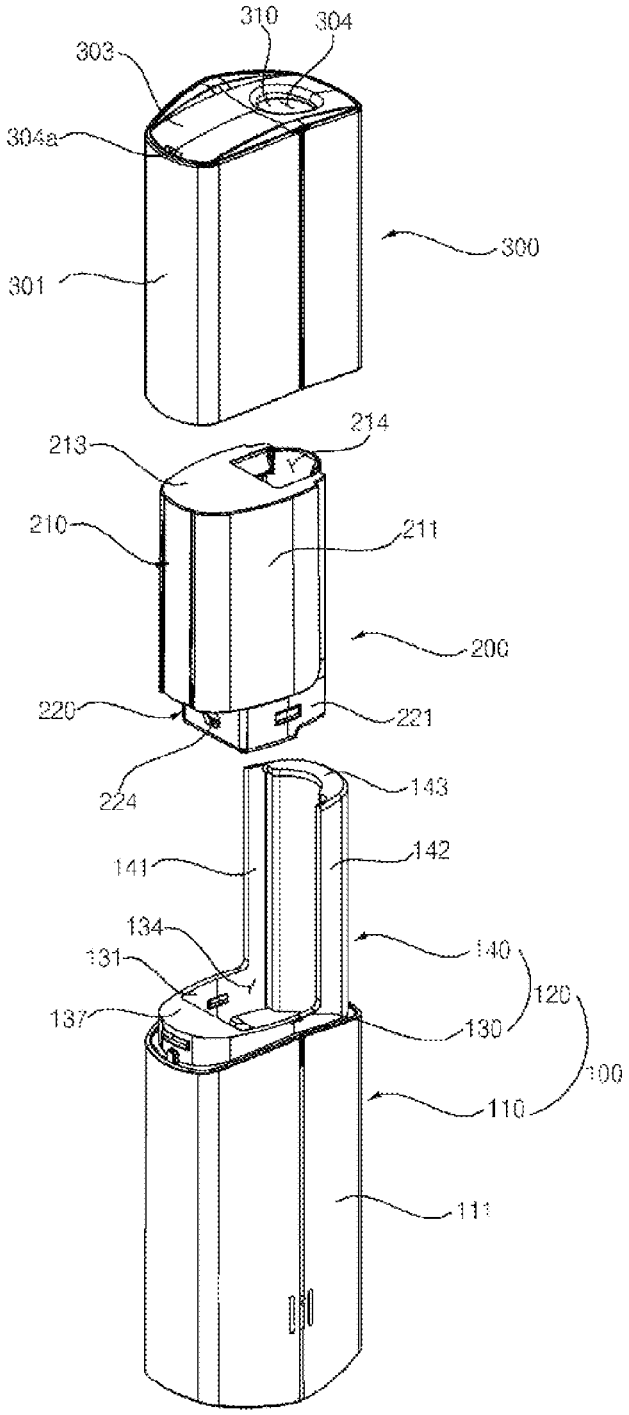

【FIG. 2】
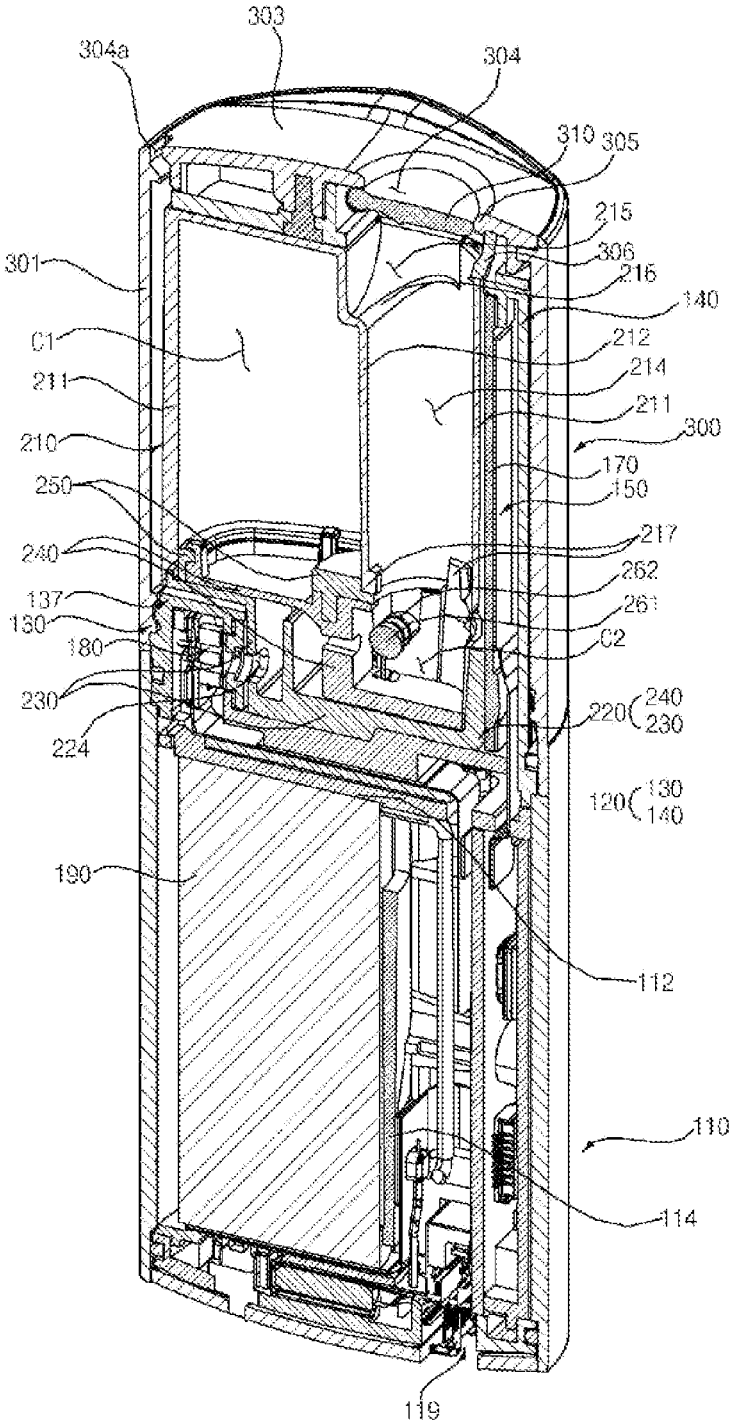

【FIG. 3】
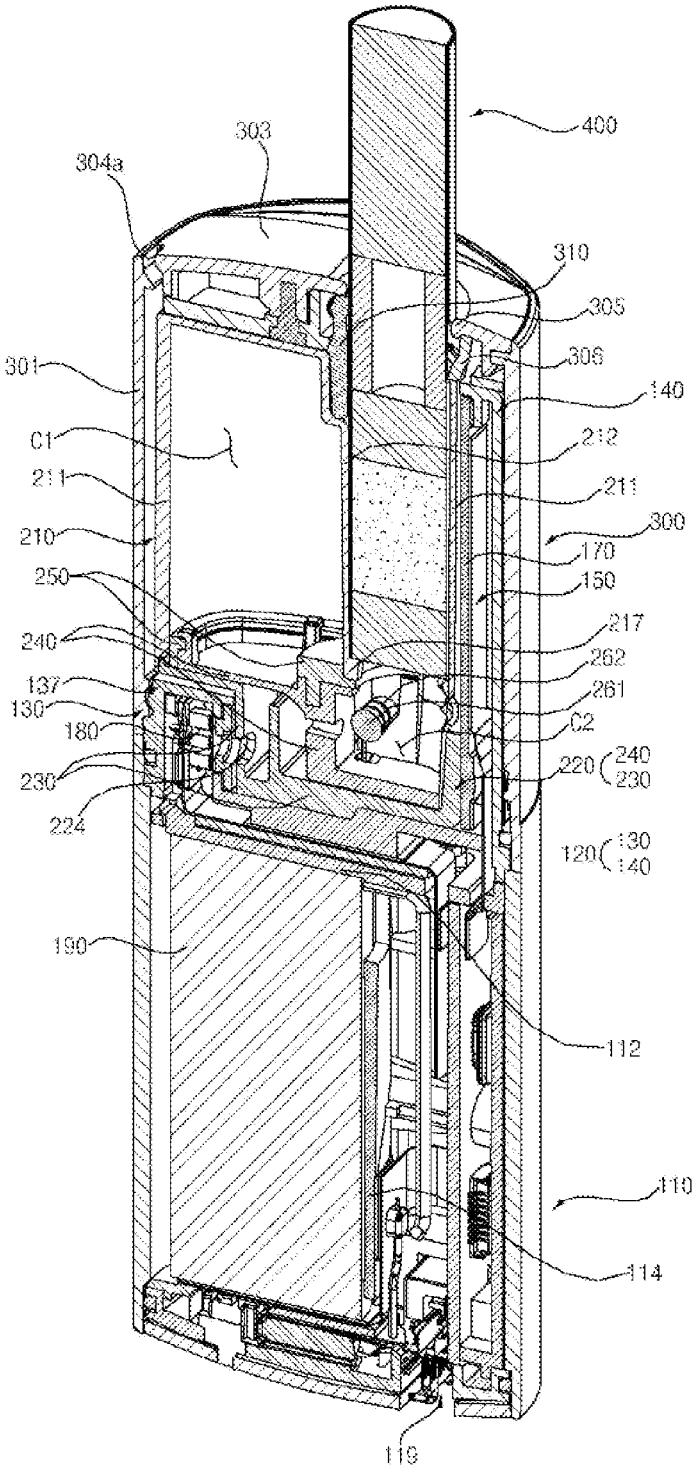

【FIG. 4】
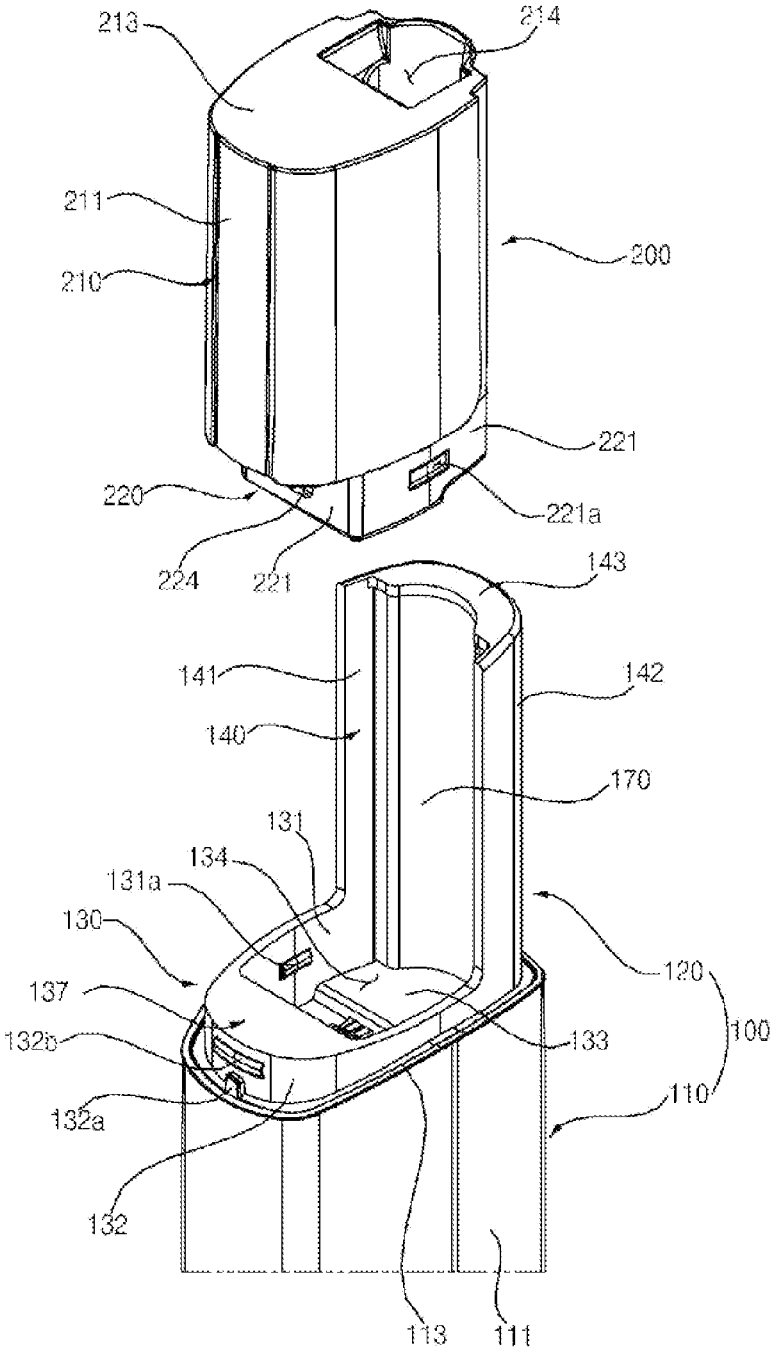

【FIG. 5】
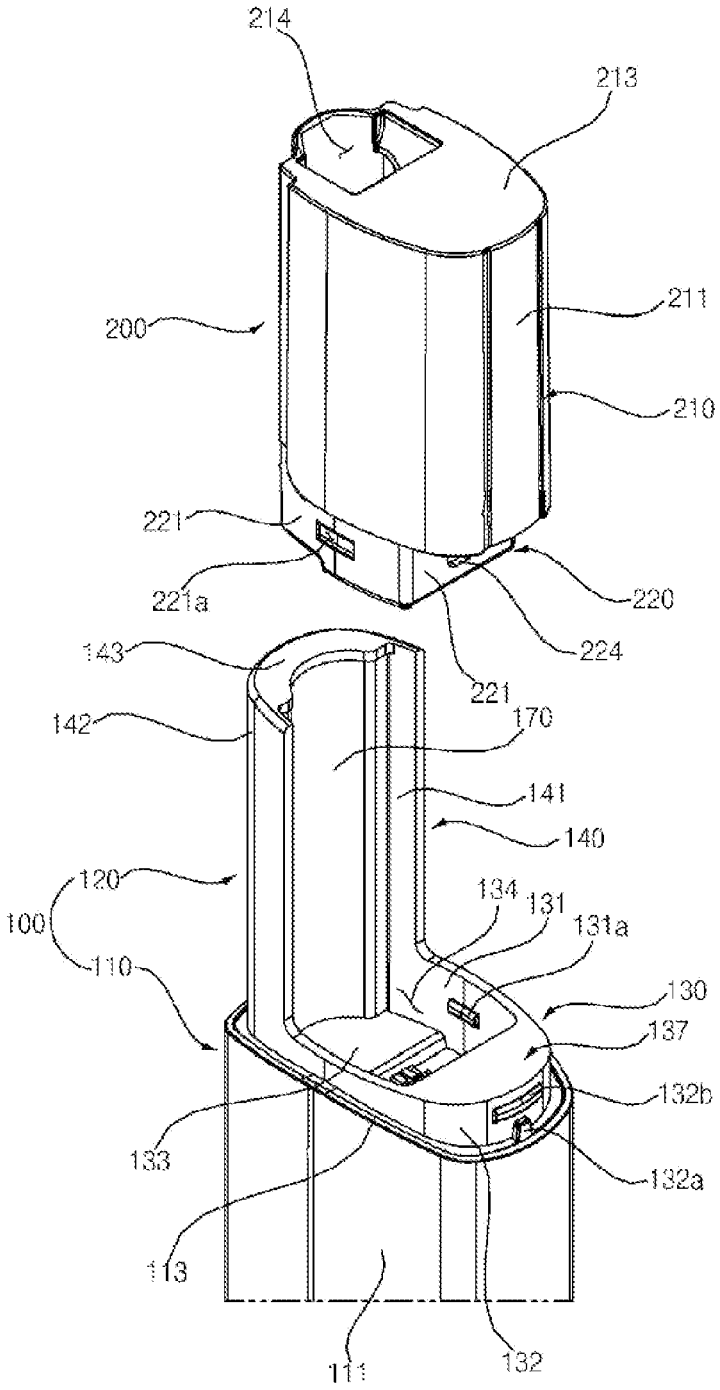

【FIG. 6】
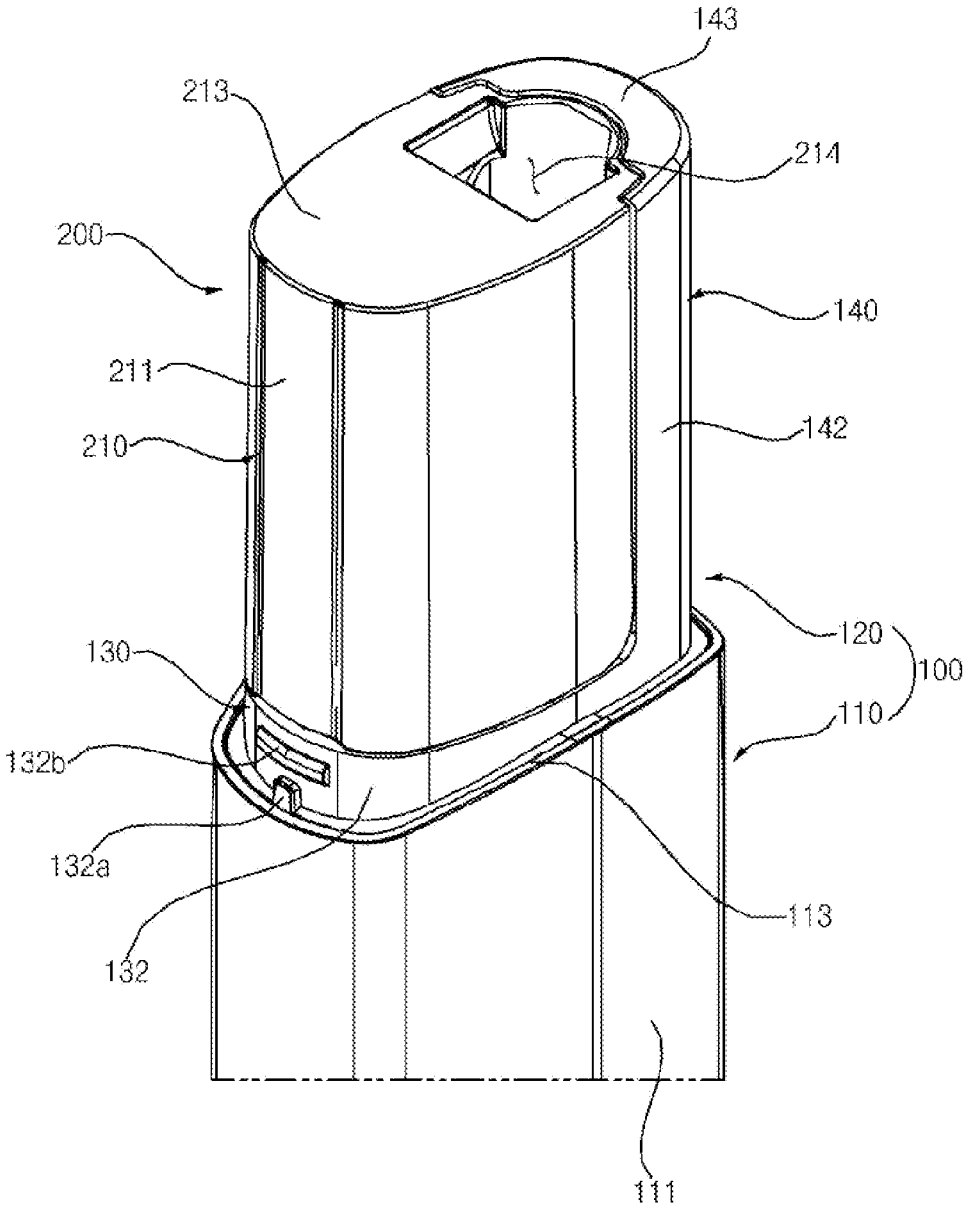

【FIG. 7】
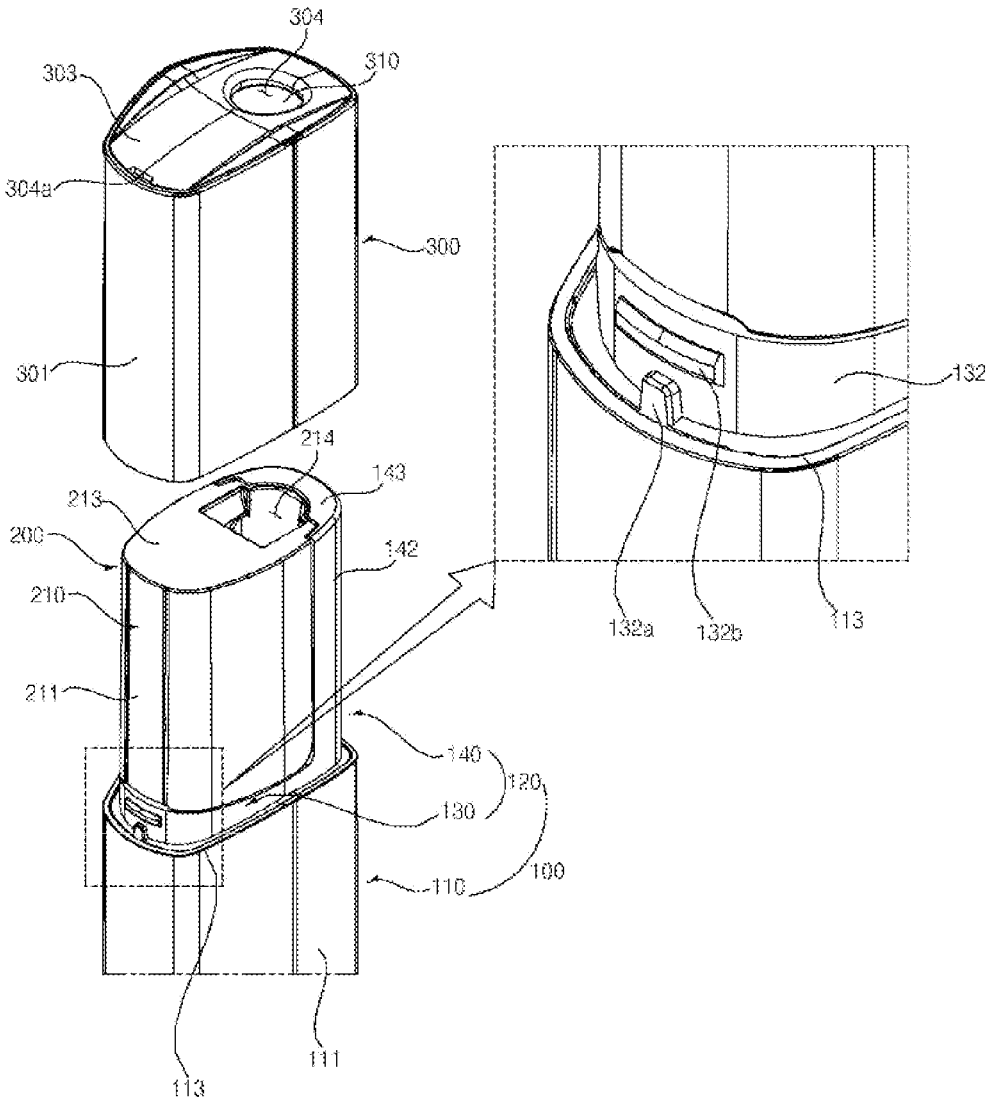

【FIG. 8】
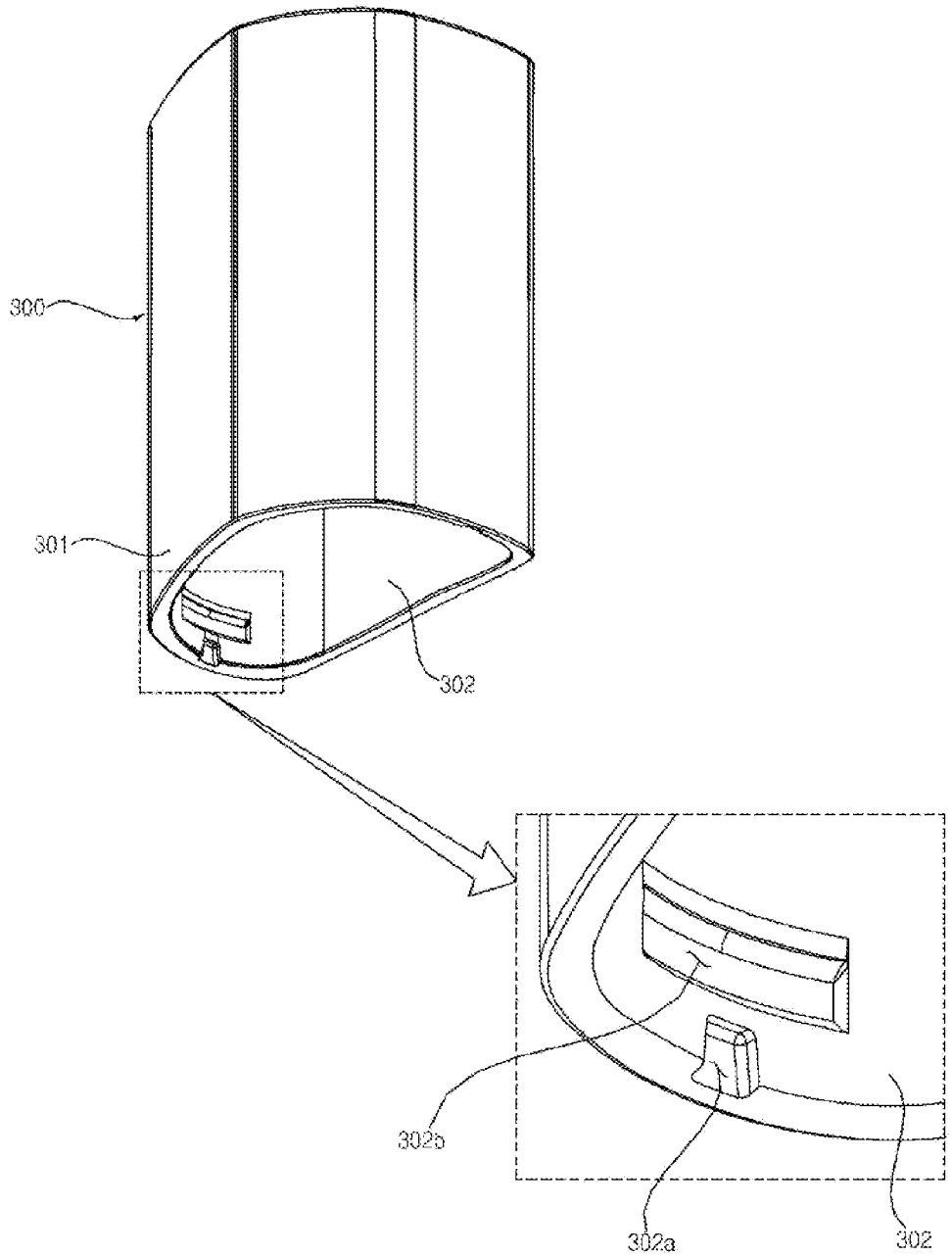

【FIG. 9】
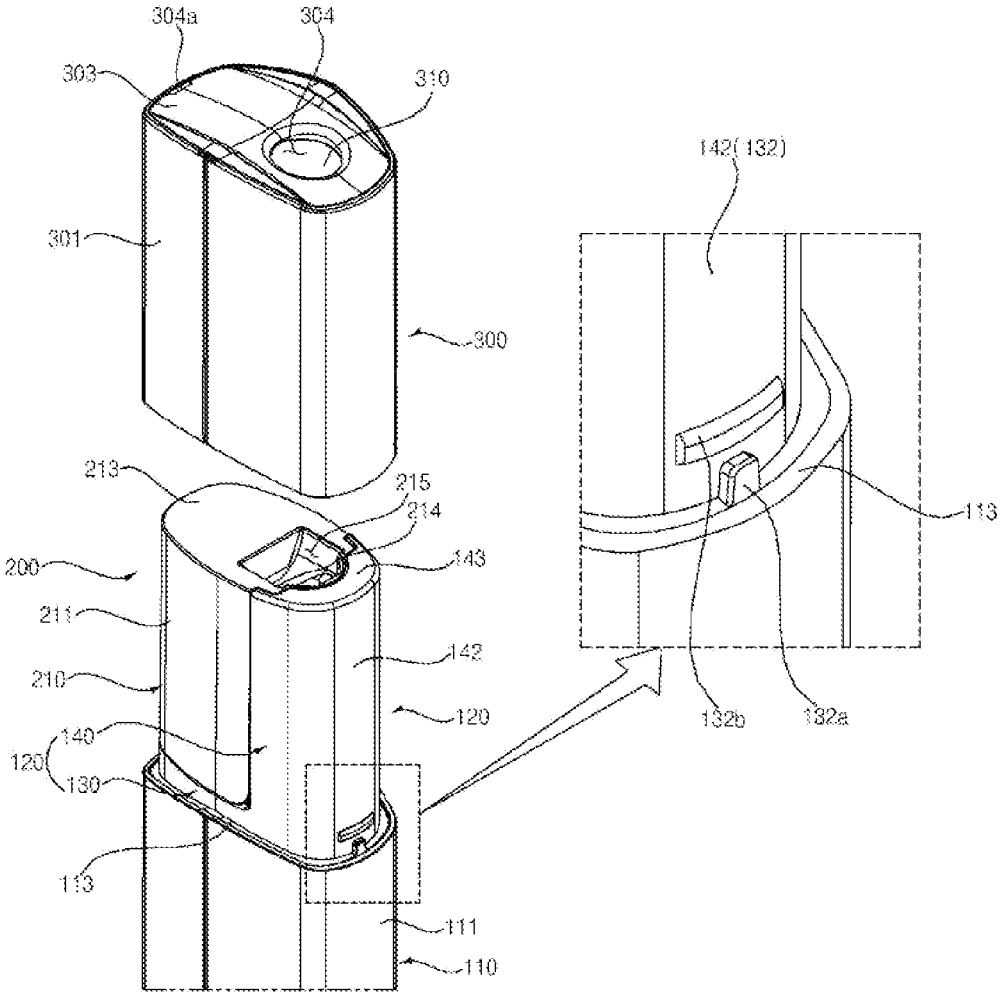

【FIG. 10】
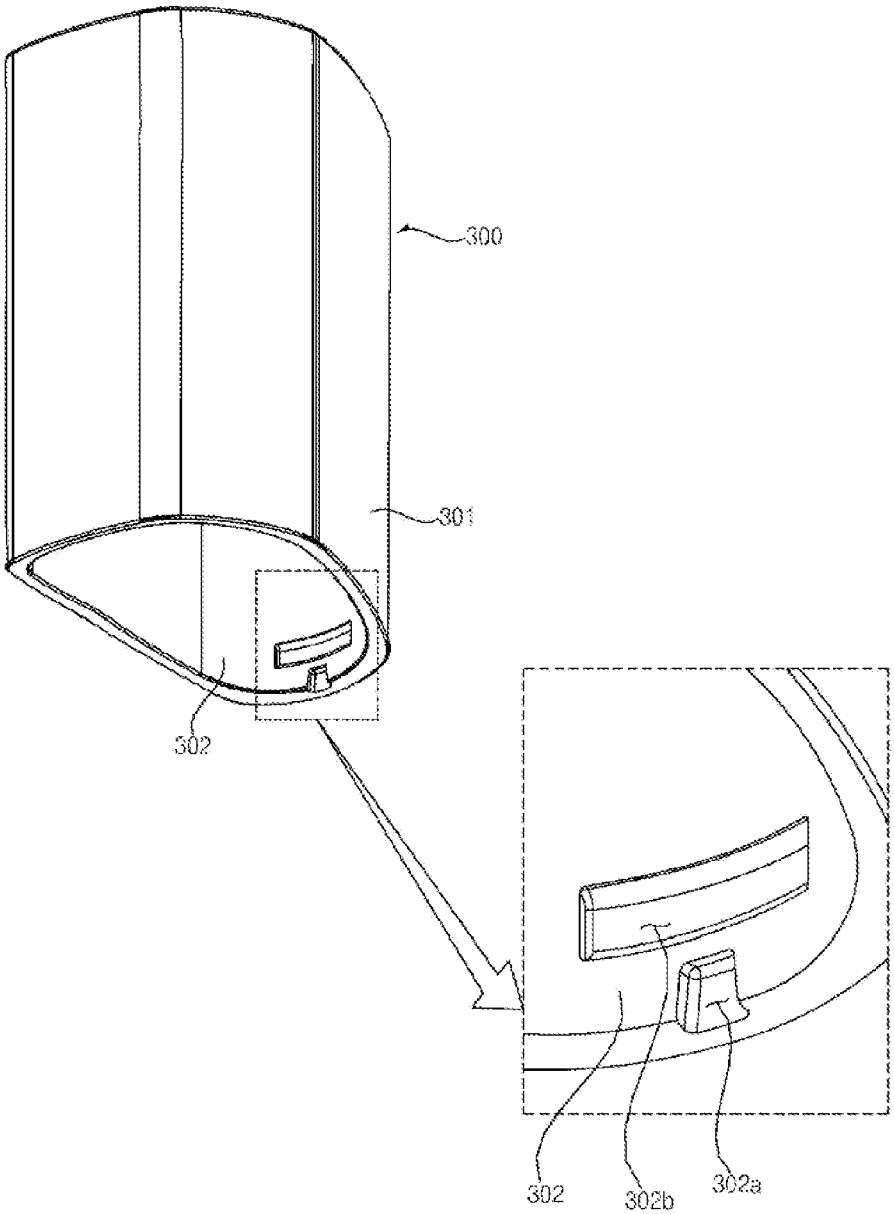

【FIG. 11】
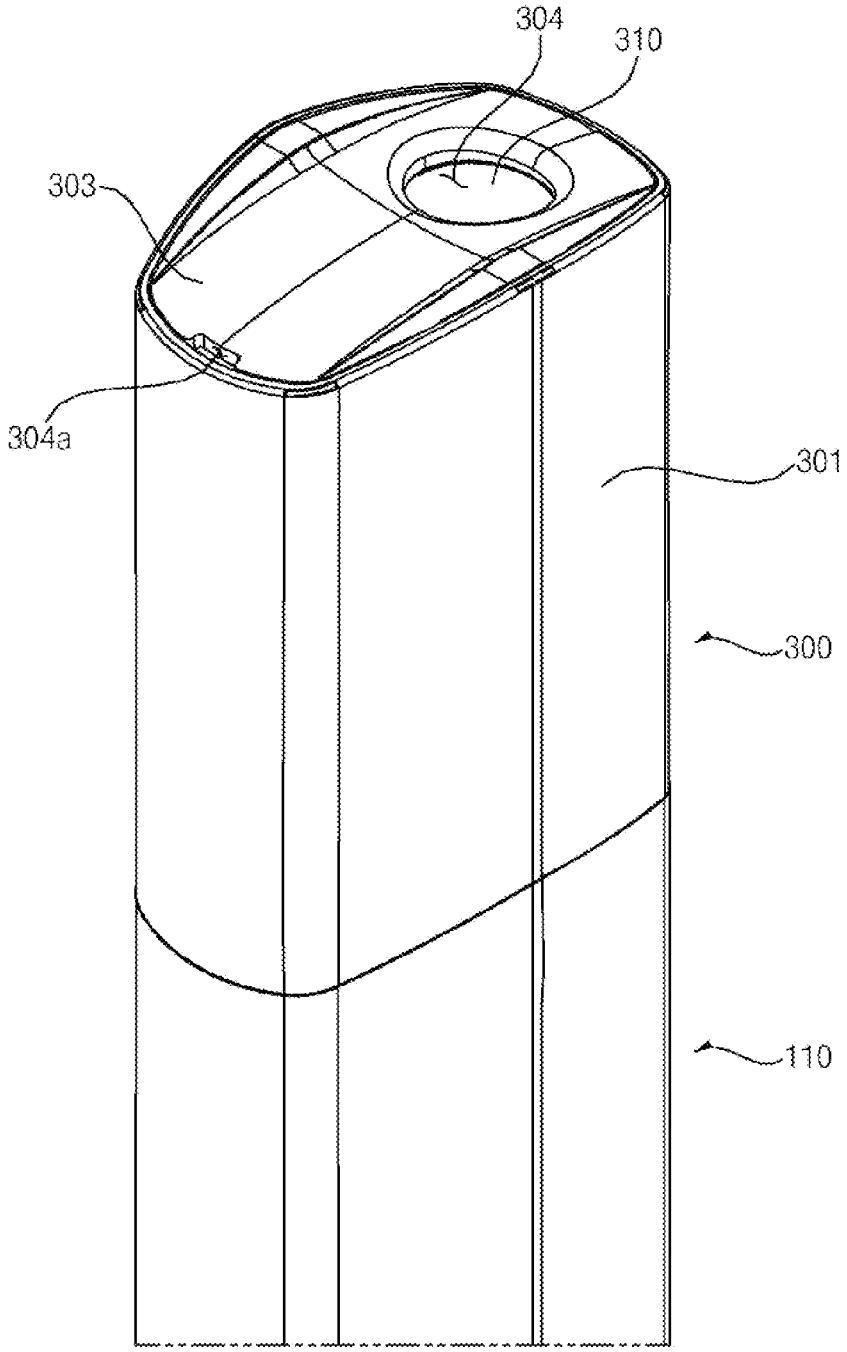

【FIG. 12】
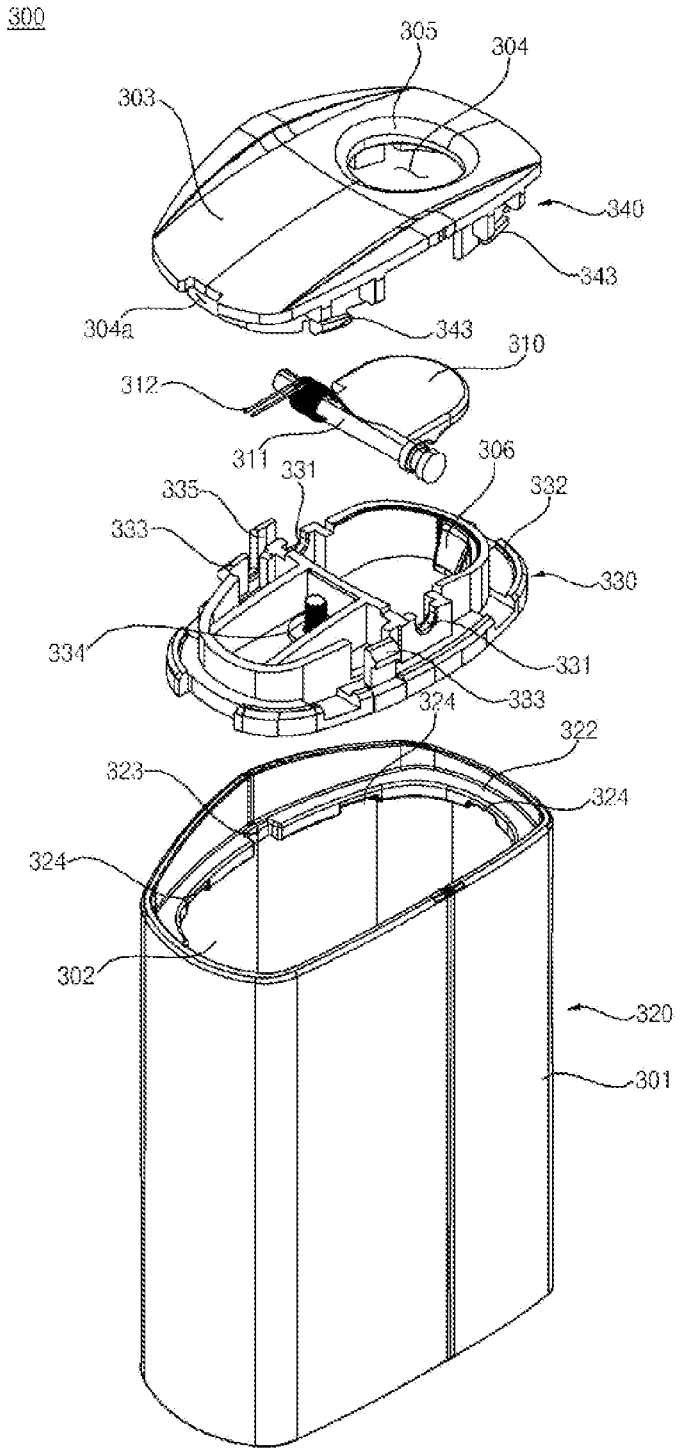

【FIG. 13】
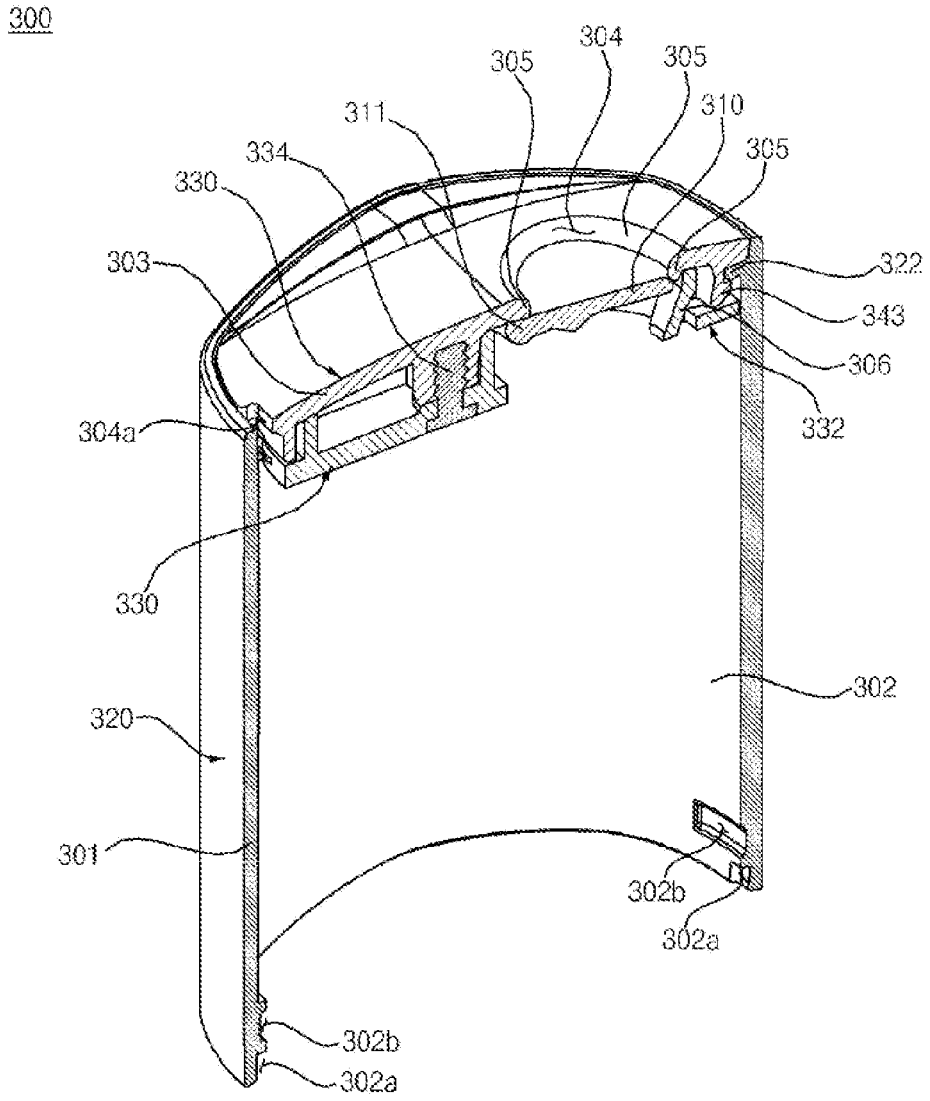

【FIG. 14】
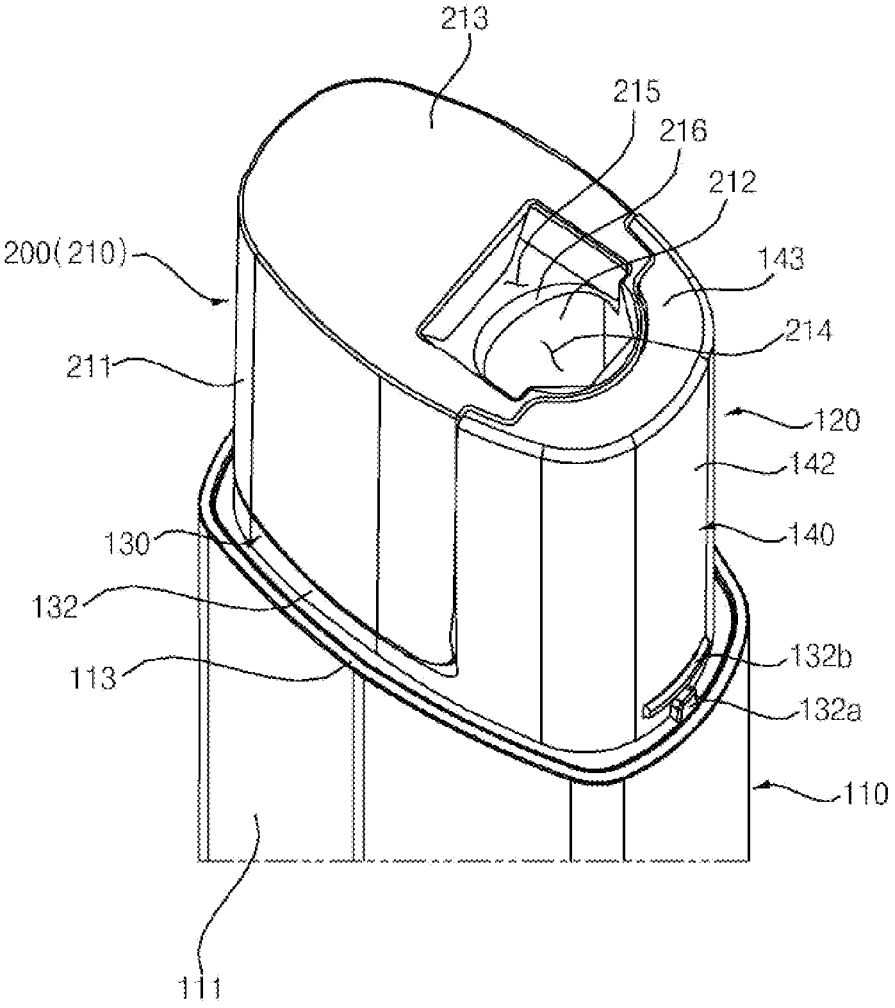

【FIG. 15】
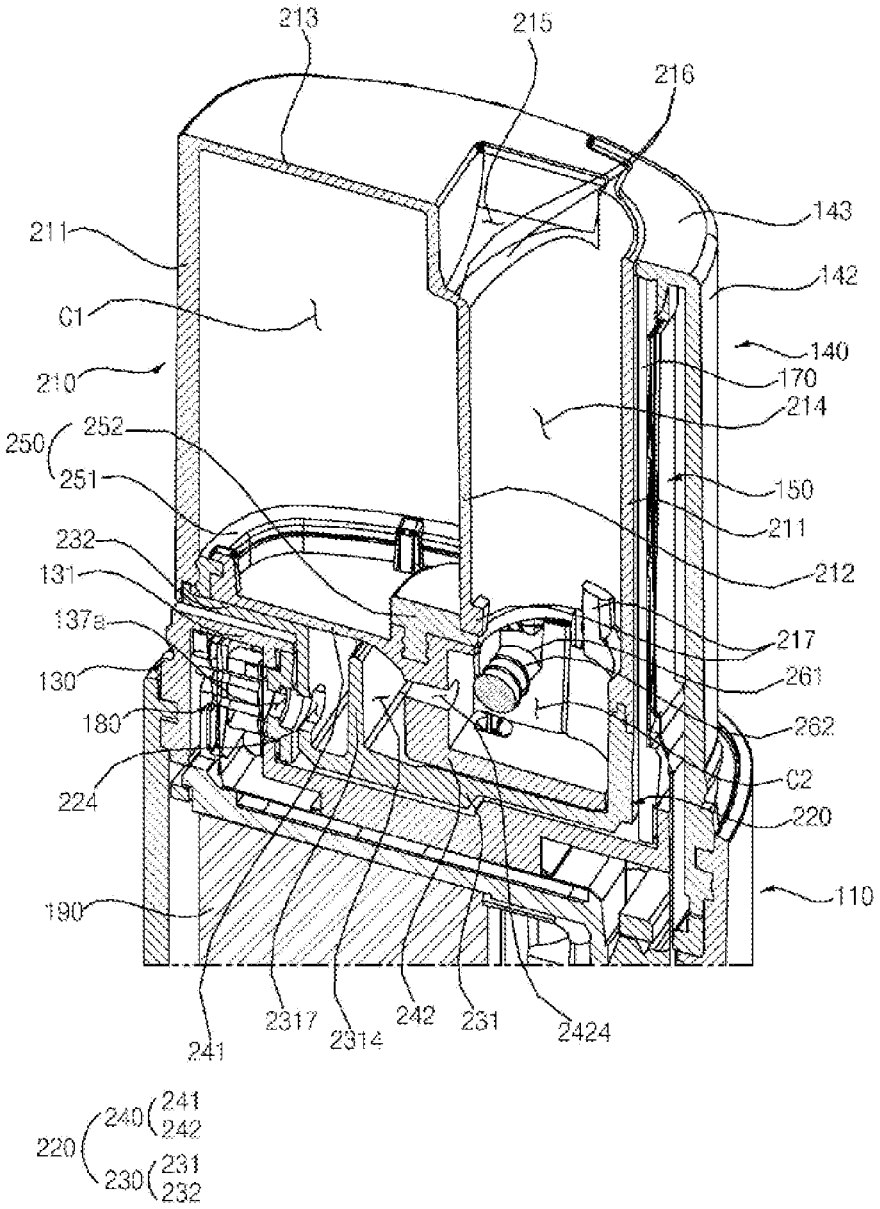

【FIG. 16】
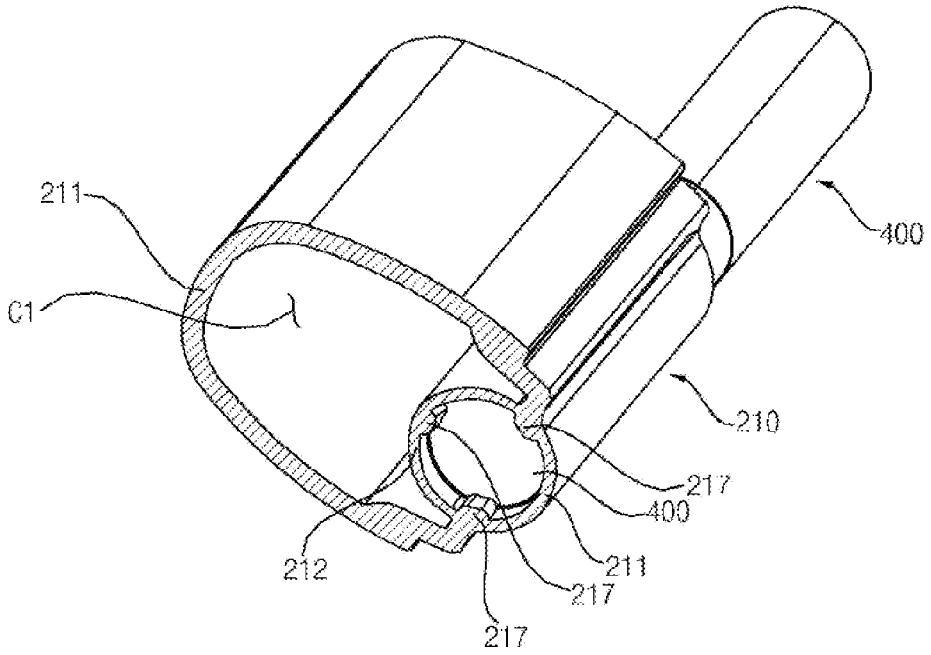

【FIG. 17】
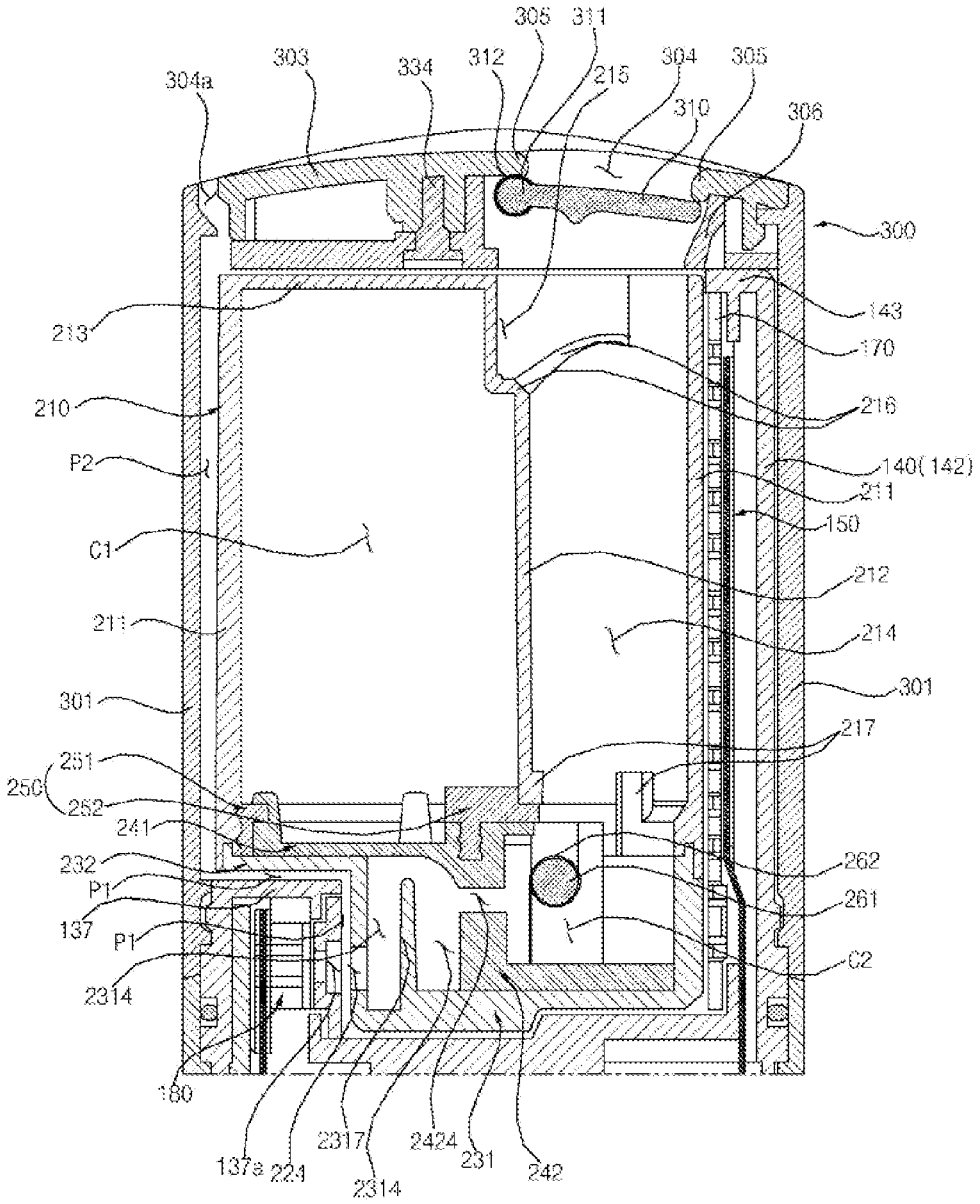

【FIG. 18】
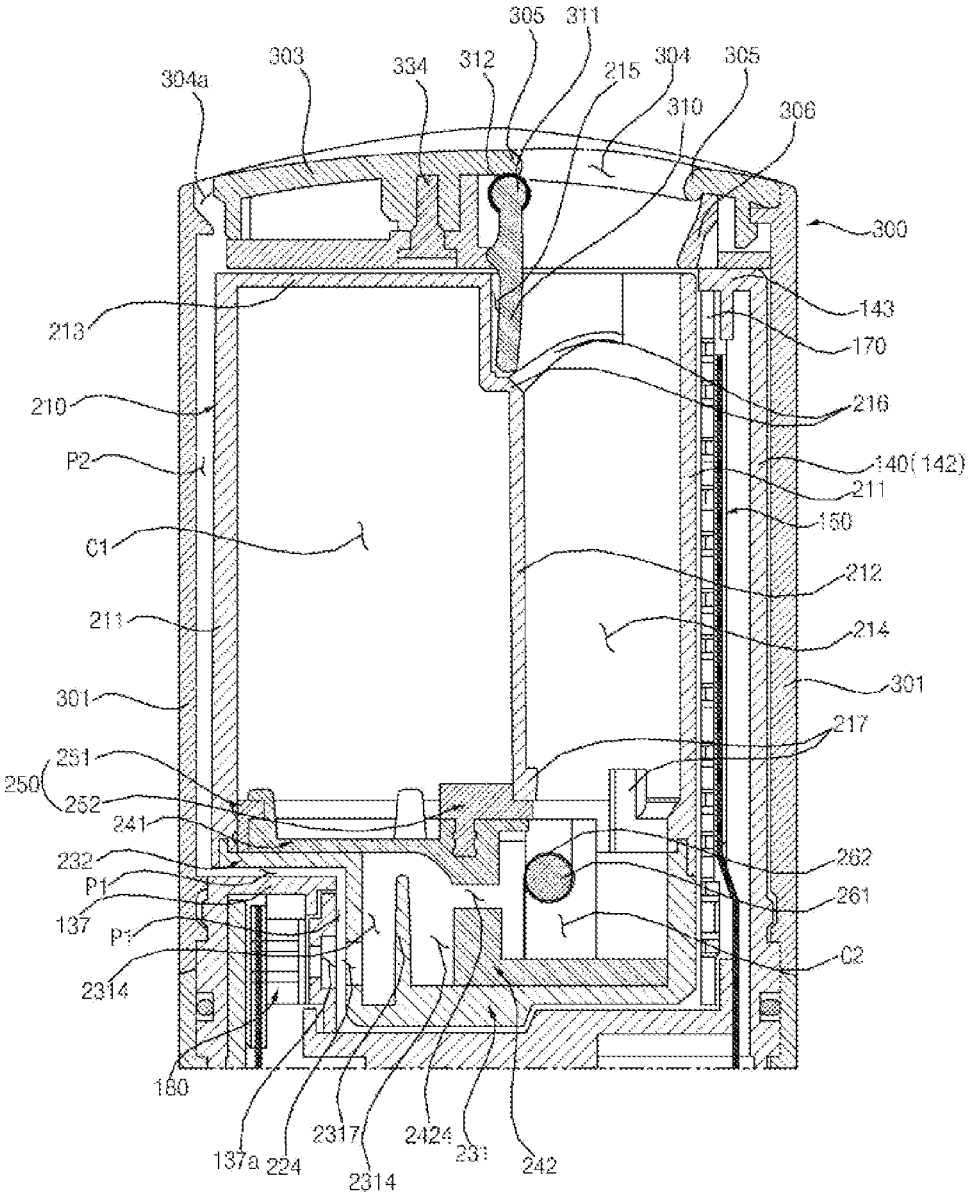

【FIG. 19】
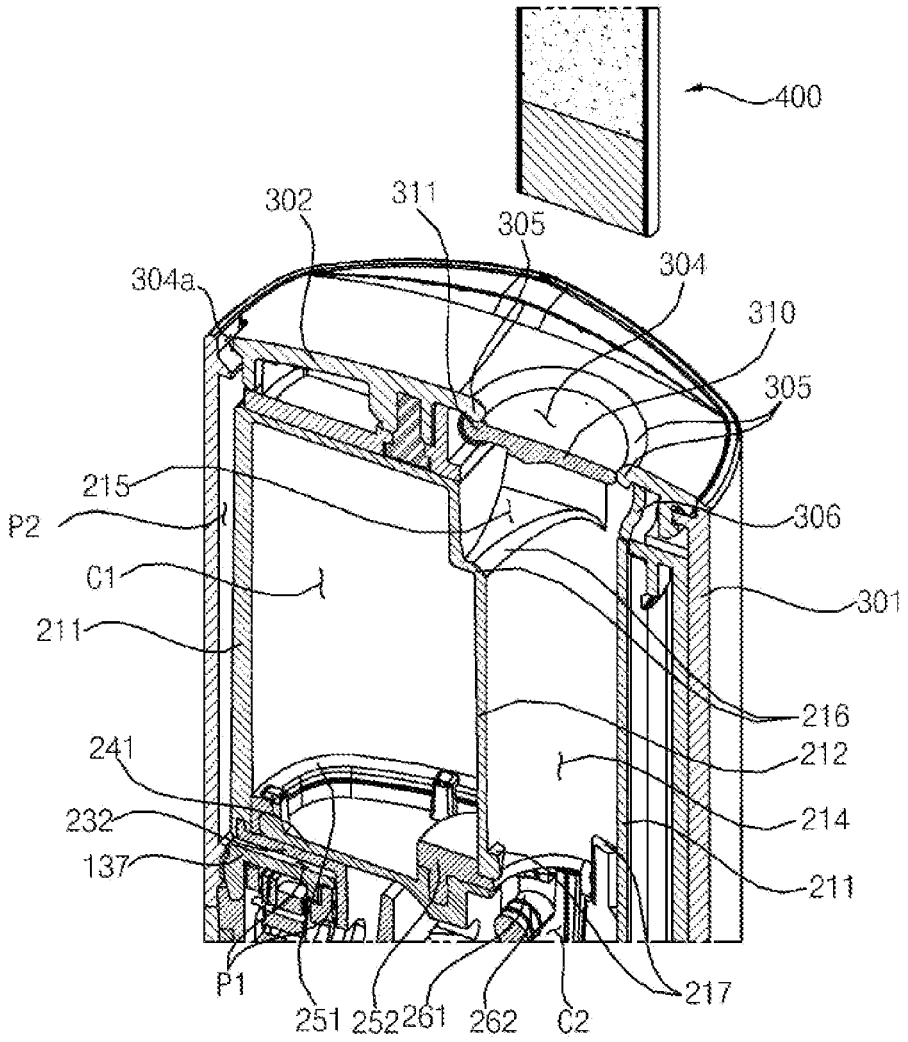

【FIG. 20】
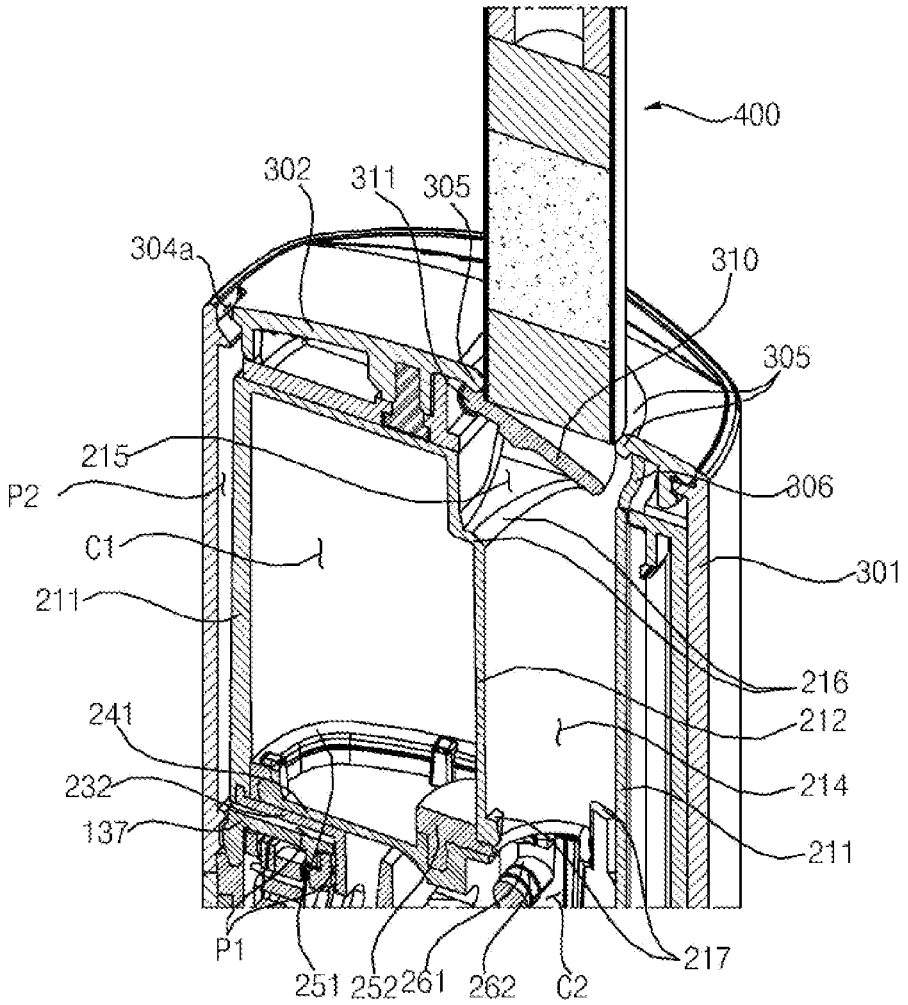

【FIG. 21】
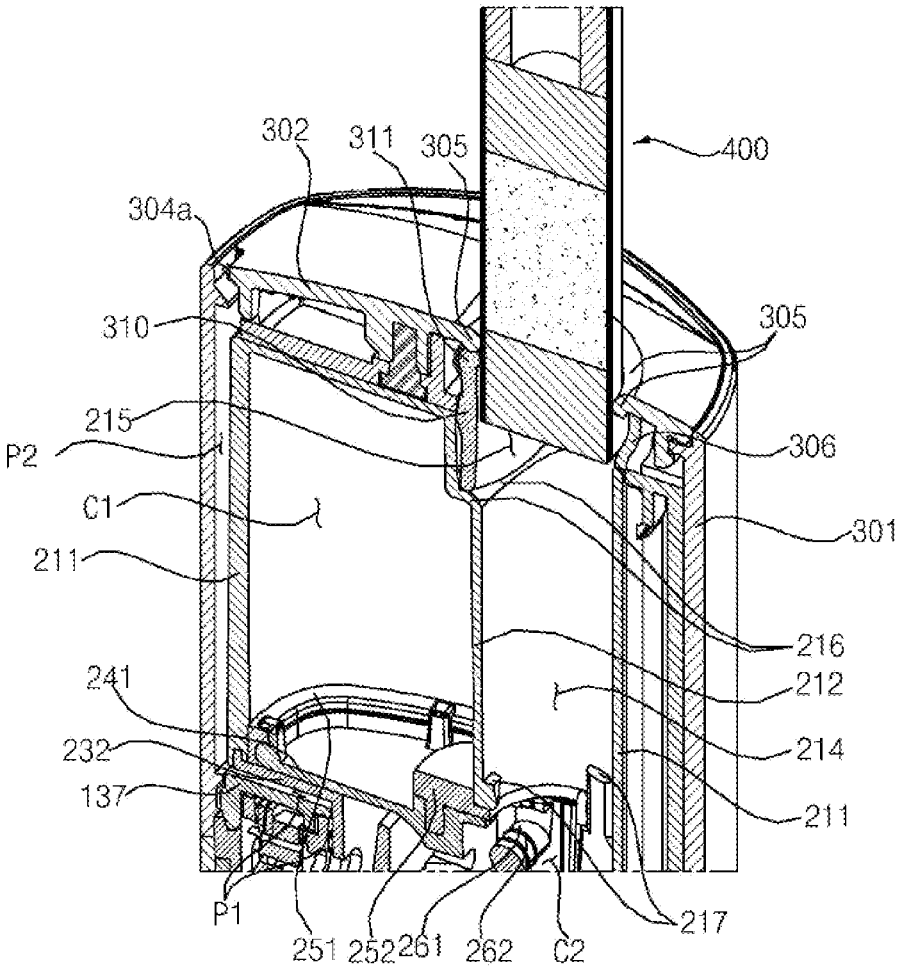

【FIG. 22】
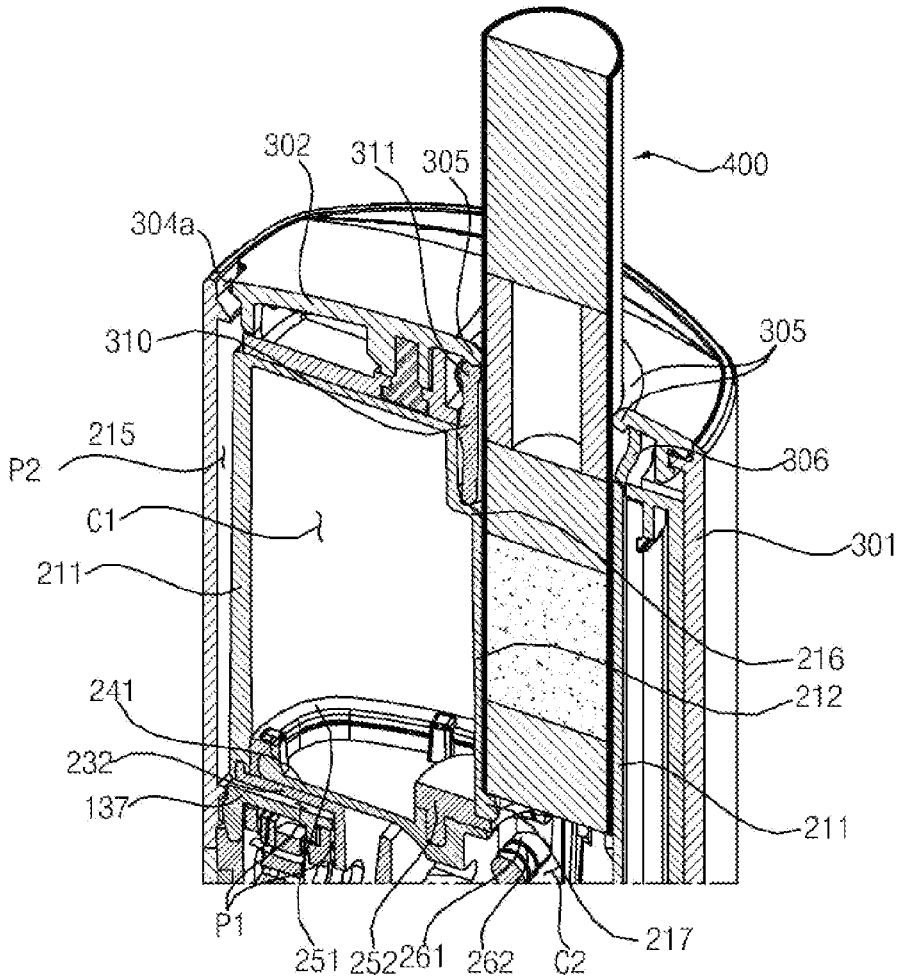

【FIG. 23】
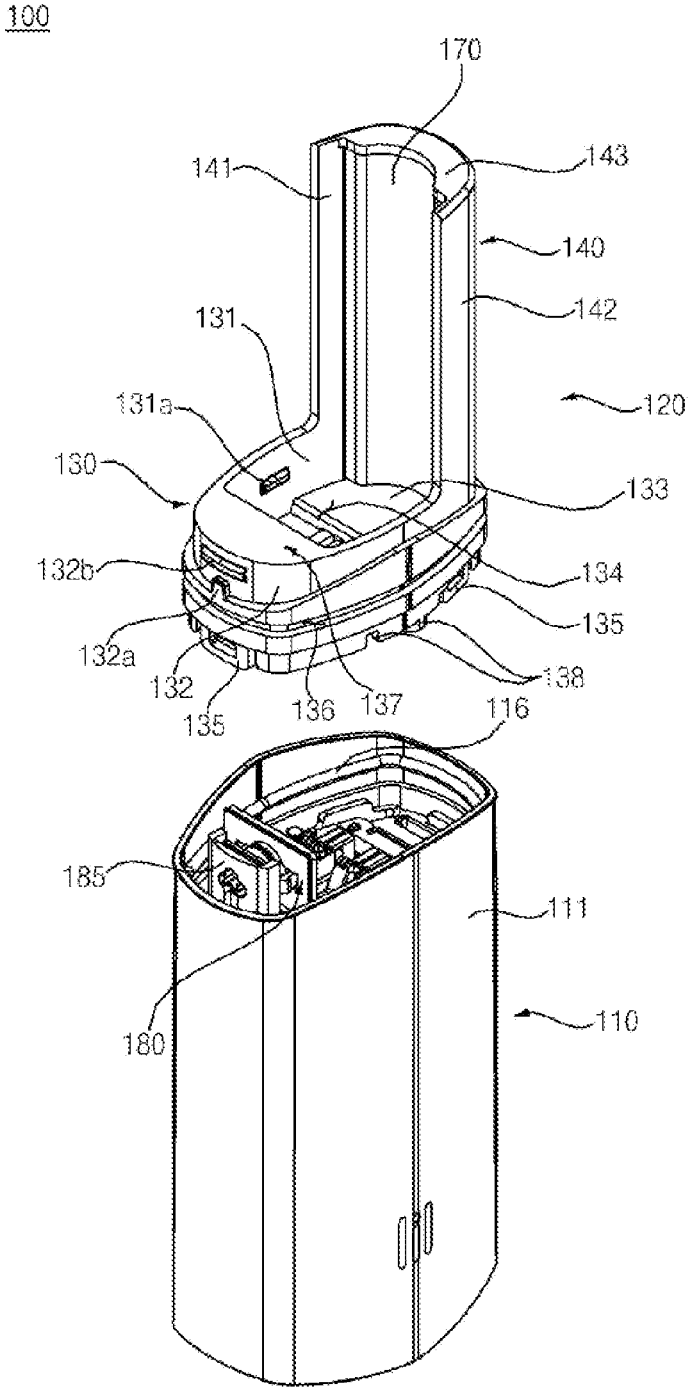

【FIG. 24】
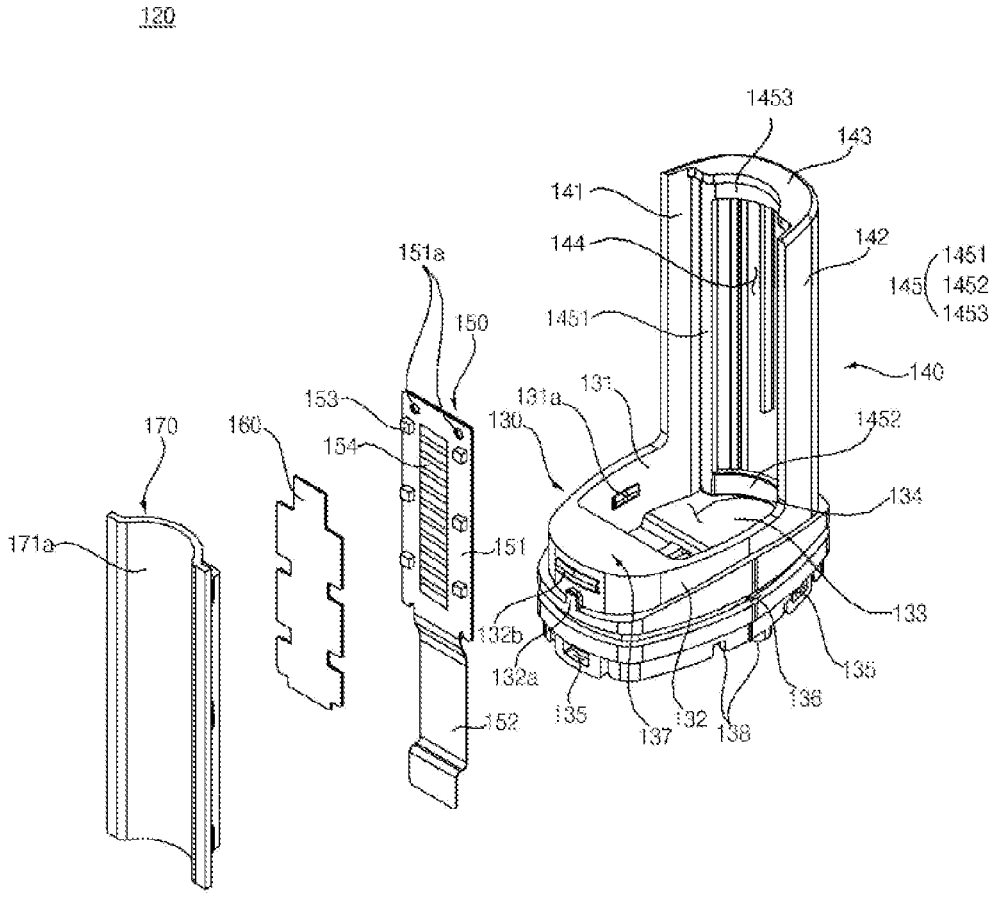

【FIG. 25】
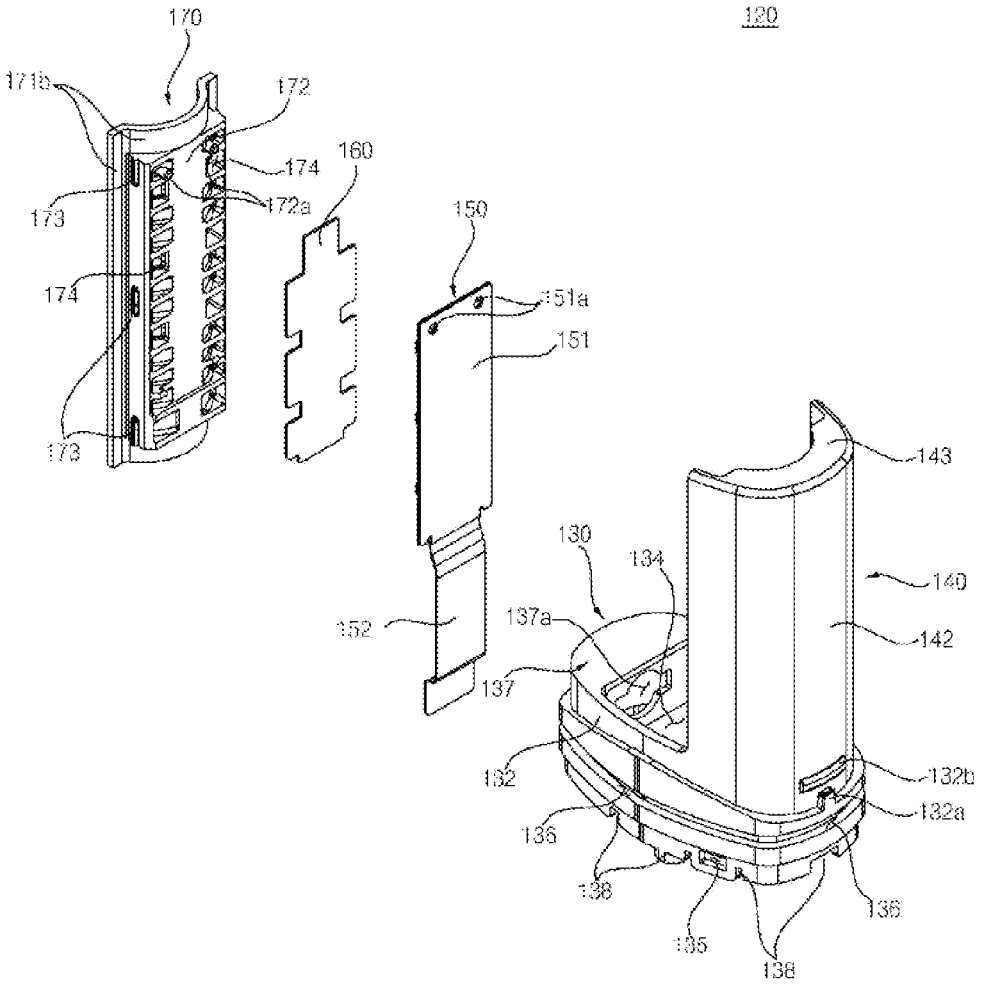

【FIG. 26】
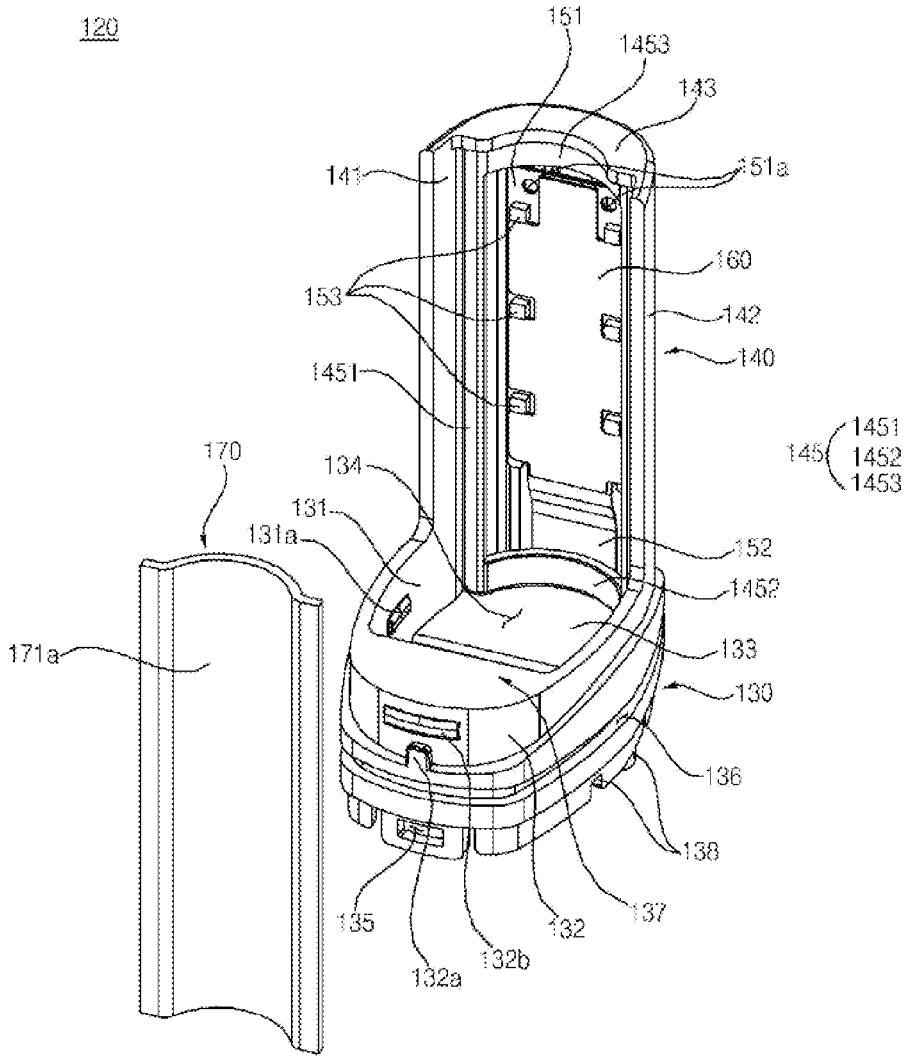

【FIG. 27】
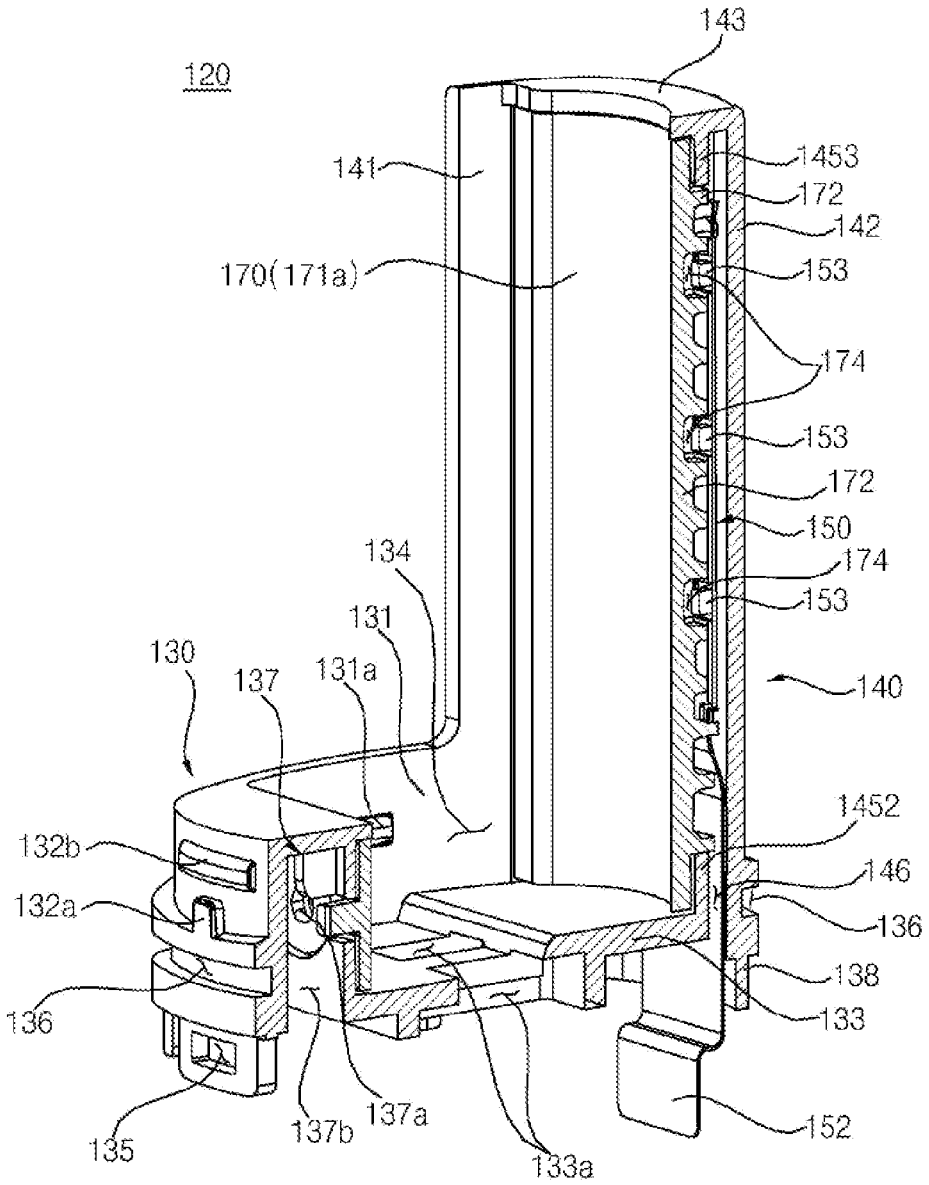

【FIG. 28】
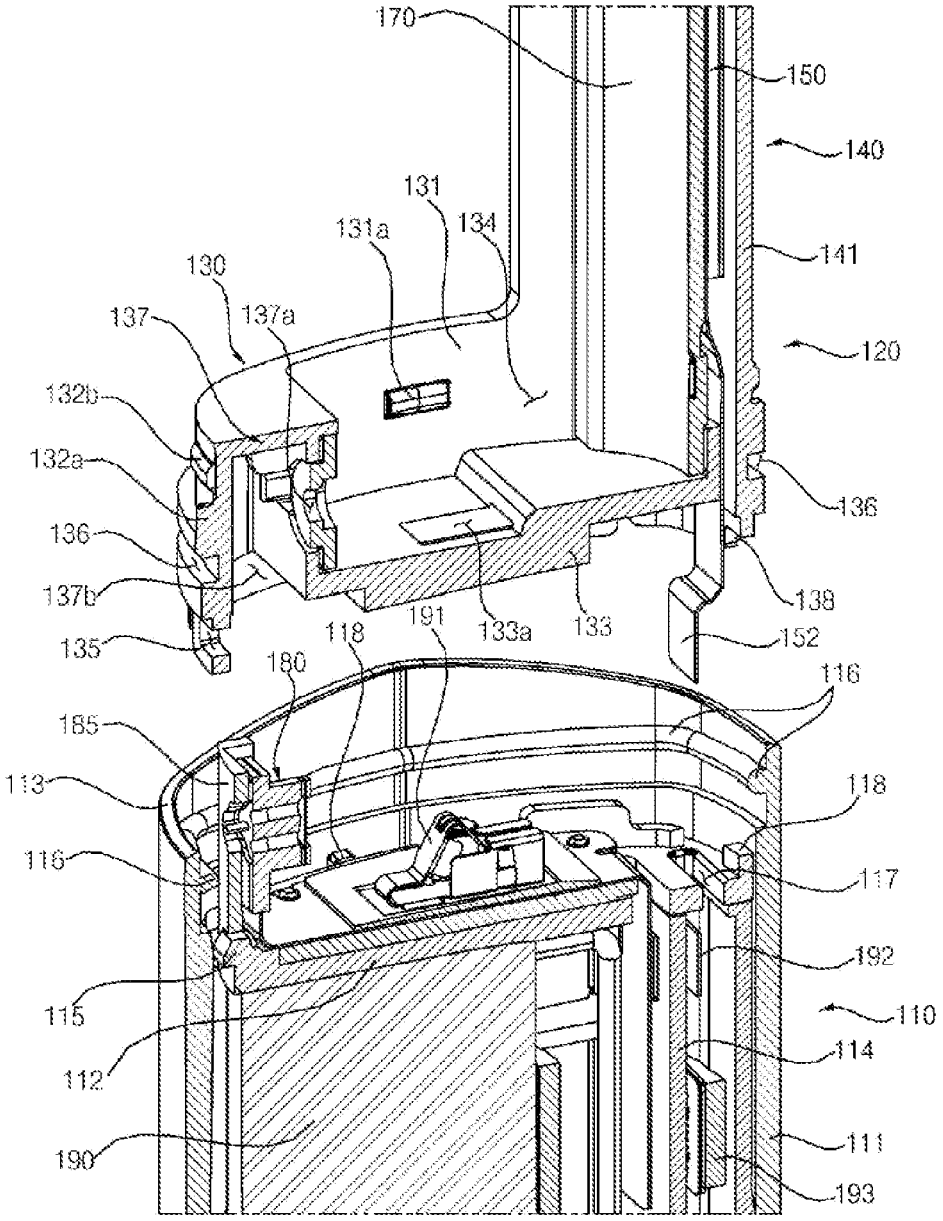

【FIG. 29】
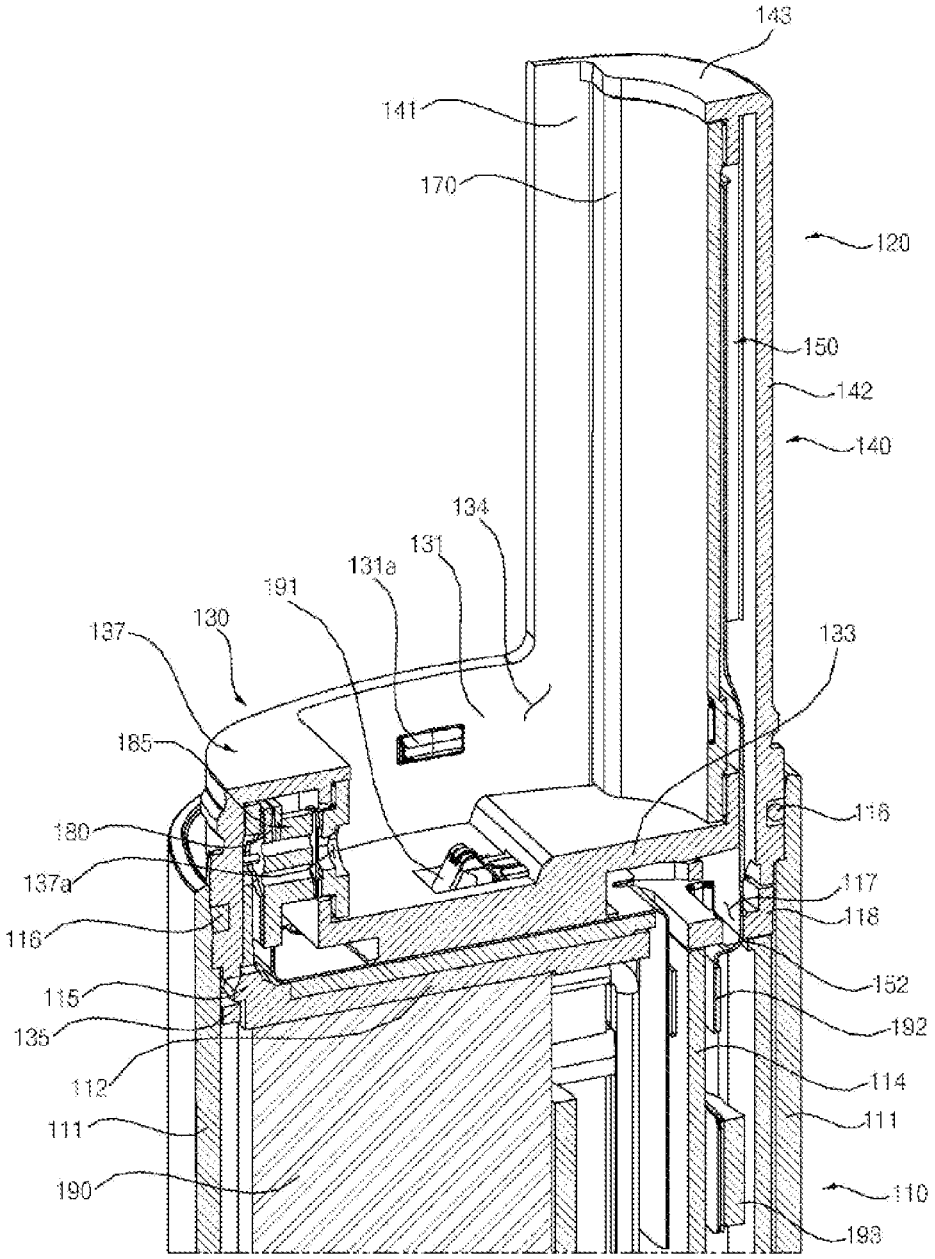

【FIG. 30】
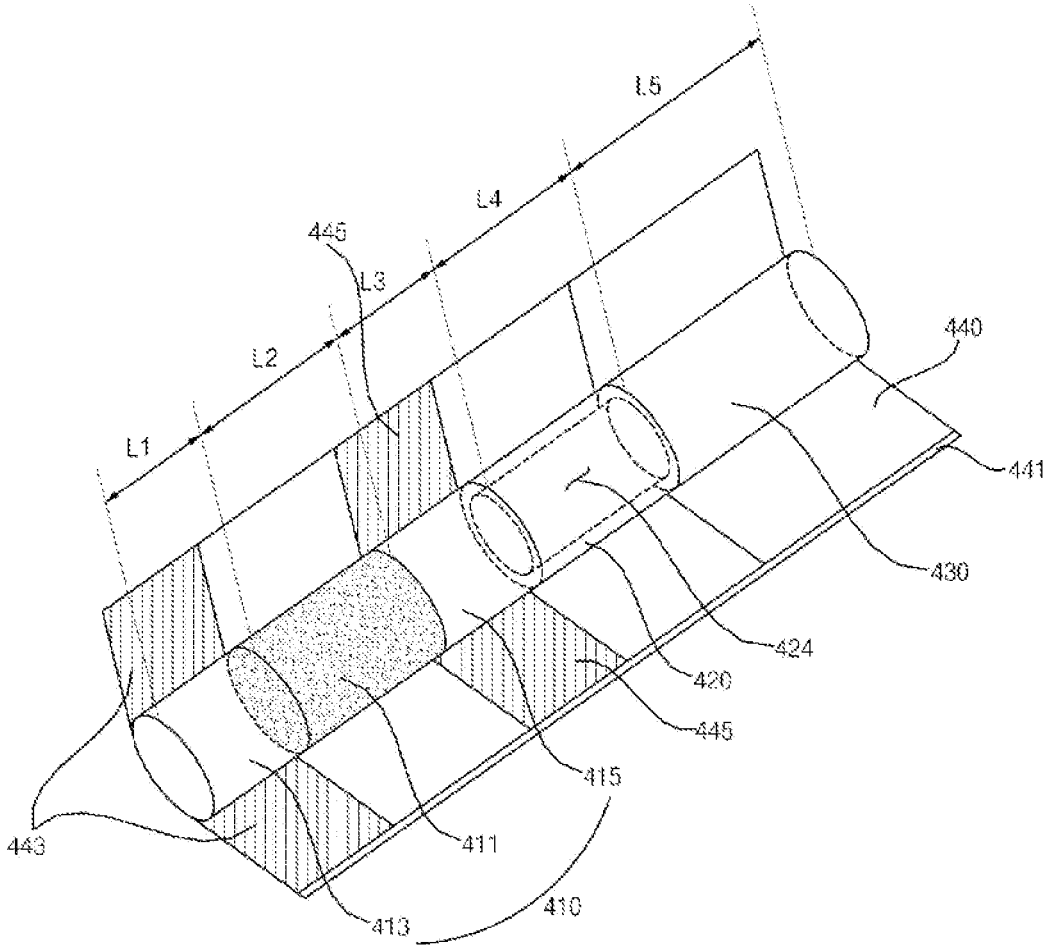

AEROSOL-GENERATING DEVICE

CROSS-REFERENCE TO RELATED APPLICATIONS

This application is the National Stage filing under 35 U.S.C. 371 of International Application No. PCT/KR2022/006099, filed on Apr. 28, 2022, which claims the benefit of earlier filing date and right of priority to Korean Application No. 10-2021-0055892, filed on Apr. 29, 2021, the contents of which are all hereby incorporated by reference herein their entirety.

TECHNICAL FIELD

The present disclosure relates to an aerosol-generating device.

BACKGROUND ART

An aerosol-generating device is a device that extracts certain components from a medium or a substance by forming an aerosol. The medium may contain a multicomponent substance. The substance contained in the medium may be a multicomponent flavoring substance. For example, the substance contained in the medium may include a nicotine component, an herbal component, and/or a coffee component. Recently, various research on aerosol-generating devices has been conducted.

DISCLOSURE OF INVENTION

Technical Problem

It is an object of the present disclosure to solve the above and other problems.

It is another object of the present disclosure to provide an aerosol-generating device having a stable structure for coupling a cartridge storing a liquid.

It is still another object of the present disclosure to provide an aerosol-generating device having a structure capable of improving the efficiency of use of space into which a stick is inserted and of opening and closing the space into which the stick is inserted.

It is still another object of the present disclosure to provide an aerosol-generating device capable of ensuring the stability of a stick insertion structure.

It is still another object of the present disclosure to provide an aerosol-generating device capable of improving the efficiency of use of a liquid storage space and gas flow efficiency.

It is still another object of the present disclosure to provide an aerosol-generating device capable of providing information for improving user convenience.

Solution to Problem

In accordance with an aspect of the present disclosure for accomplishing the above objects, there is provided an aerosol-generating device including a body: a cartridge coupled to the body, the cartridge comprising a first chamber configured to store a liquid and an insertion space formed separately from the first chamber and opened to an outside; and a cover configured to move between an open position and a closed position to open and close the insertion space, wherein the cartridge comprises: a cover recess formed adjacent to the opening of the insertion space, wherein the cover recess is recessed outward from the insertion space, wherein the cover is located in the cover recess when the cover is in the open position.

Advantageous Effects of Invention

According to at least one of embodiments of the present disclosure, an aerosol-generating device having a stable structure for coupling a cartridge storing a liquid may be provided.

According to at least one of embodiments of the present disclosure, an aerosol-generating device having a structure capable of improving the efficiency of use of space into which a stick is inserted and of opening and closing the space into which the stick is inserted may be provided.

According to at least one of embodiments of the present disclosure, an aerosol-generating device capable of ensuring the stability of a stick insertion structure may be provided.

According to at least one of embodiments of the present disclosure, an aerosol-generating device capable of improving the efficiency of use of a liquid storage space and gas flow efficiency may be provided.

According to at least one of embodiments of the present disclosure, an aerosol-generating device capable of providing information for improving user convenience may be provided.

Additional applications of the present disclosure will become apparent from the following detailed description. However, because various changes and modifications will be clearly understood by those skilled in the art within the spirit and scope of the present disclosure, it should be understood that the detailed description and specific embodiments, such as preferred embodiments of the present disclosure, are merely given by way of example.

BRIEF DESCRIPTION OF DRAWINGS

The above and other objects, features, and other advantages of the present disclosure will be more clearly understood from the following detailed description taken in conjunction with the accompanying drawings, in which:

FIGS. 1 to 30 are views showing examples of an aerosol-generating device according to embodiments of the present disclosure.

MODE FOR THE INVENTION

Hereinafter, the embodiments disclosed in the present specification will be described in detail with reference to the accompanying drawings, and the same or similar elements are denoted by the same reference numerals even though they are depicted in different drawings, and redundant descriptions thereof will be omitted.

In the following description, with respect to constituent elements used in the following description, the suffixes "module" and "unit" are used only in consideration of facilitation of description, and do not have mutually distinguished meanings or functions.

In addition, in the following description of the embodiments disclosed in the present specification, a detailed description of known functions and configurations incorporated herein will be omitted when the same may make the subject matter of the embodiments disclosed in the present specification rather unclear. In addition, the accompanying drawings are provided only for a better understanding of the embodiments disclosed in the present specification and are not intended to limit the technical ideas disclosed in the present specification. Therefore, it should be understood that the accompanying drawings include all modifications, equivalents, and substitutions within the scope and sprit of the present disclosure.

It will be understood that although the terms "first", "second", etc., may be used herein to describe various components, these components should not be limited by these terms. These terms are only used to distinguish one component from another component.

It will be understood that when a component is referred to as being "connected to" or "coupled to" another component, it may be directly connected to or coupled to another component, or intervening components may be present. On the other hand, when a component is referred to as being "directly connected to" or "directly coupled to" another component, there are no intervening components present.

As used herein, the singular form is intended to include the plural forms as well, unless the context clearly indicates otherwise.

Referring to FIG. 1, an aerosol-generating device may include at least one of a body 100, a cartridge 200, or a cap 300.

The body 100 may include at least one of a lower body 110 or an upper body 120. The lower body 110 may accommodate various components necessary for power supply or control, such as a battery or a controller. The lower body 110 may form the external appearance of the aerosol-generating device. The upper body 120 may be disposed on the lower body 110. The cartridge 200 may be coupled to the upper body 120. The body 100 may be referred to as a main body 100.

The upper body 120 may include at least one of a mount 130 or a column 140. The mount 130 may be disposed on the lower body 110. The mount 130 may provide a space 134 into which the lower portion of the cartridge 200 is inserted. The mount 130 may have an open upper side, and may define therein the space 134. The mount 130 may surround the lower portion of the cartridge 200 inserted into the space 134. The mount 130 may fix the cartridge 200. The mount 130 may support the lower portion of the cartridge 200. The column 140 may be disposed on the lower body 110. The column 140 may have an elongated shape. The column 140 may extend upwards from one side of the mount 130. The column 140 may face one side wall of the cartridge 200. The column 140 may be disposed parallel to the cartridge 200. The column 140 may have a shape that covers the side wall of the cartridge 200. The column 140 may support the side wall of the cartridge 200.

A first chamber C1 may be formed in a portion of the inside of a first container 210, and an insertion space 214 may be formed in another portion of the inside of the first container 210. The insertion space 214 may be disposed adjacent to the column 140. The column 140 may be disposed adjacent to the other portion of the inside of the first container 210 in which the insertion space 214 is formed.

The cartridge 200 may be detachably coupled to the body 100. The cartridge 200 may provide space for storing liquid therein. The cartridge 200 may have the insertion space 214 formed therein. One end of the insertion space 214 may be open to form an opening. The insertion space 214 may be exposed to the outside through the opening. The opening may be defined as one end of the insertion space 214.

The cartridge 200 may include at least one of a first container 210 or a second container 220. The second container 220 may be coupled to the first container 210.

The first container 210 may be coupled to the upper side of the second container 220. The first container 210 may provide space for storing liquid therein. The first container 210 may have an open upper side, and may have formed therein the insertion space 214, which is elongated in the vertical direction. A stick 400 (refer to FIG. 3) may be inserted into the insertion space 214. One side wall of the first container 210 may face the column 140. The column 140 may cover the side wall of the first container 210. The first container 210 may be disposed on the mount 130.

The second container 220 may be coupled to the lower side of the first container 210. The second container 220 may provide space for mounting a wick 261 (refer to FIG. 2) and a heater 262 (refer to FIG. 2) therein. The second container 220 may be inserted into the space 134 provided by the mount 130. The space 134 in the mount 130 may be referred to as a cartridge accommodation space 134. The mount 130 may surround the second container 220. The second container 220 may be coupled to the mount 130.

The cap 300 may be detachably coupled to the body 100. The cap 300 may cover the cartridge 200. The cap 300 may cover at least a portion of the body 100. The cap 300 may protect the cartridge 200 and/or at least a portion of the body 100 from the outside. A user may separate the cap 300 from the body 100 in order to replace the cartridge 200.

The cap 300 may be coupled to the upper portion of the body 100. The cap 300 may be coupled to the upper side of the lower body 110. The cap 300 may cover the upper body 120. The cap 300 may cover the cartridge 200. A side wall 301 of the cap 300 may surround the side portion of the cartridge 200. The side wall 301 of the cap 300 may surround the side portion of the upper body 120. An upper wall 303 of the cap 300 may cover the upper portion of the cartridge 200. The upper wall 303 of the cap 300 may cover the upper portion of the column 140.

The cap 300 may have an insertion hole 304 formed therein. The upper wall 303 of the cap 300 may be open to form the insertion hole 304. The insertion hole 304 may be formed at a position corresponding to the insertion space 214. The insertion hole 304 may communicate with one end or the upper end of the insertion space 214.

The cap 300 may have a cap inlet 304*a* formed therein. One side of the cap 300 may be open to form the cap inlet 304*a*. For example, the upper wall 303 of the cap 300 may be open to form the cap inlet 304*a*. For example, the side wall 301 of the cap 300 may be open to form the cap inlet 304*a*. The cap inlet 304*a* may communicate with the outside. Air may be introduced into the aerosol-generating device through the cap inlet 304*a*.

Referring to FIGS. 1 and 2, the cartridge 200 may be coupled to the body 100. The cartridge 200 may provide the first chamber C1 for storing liquid therein. The cartridge 200 may provide the insertion space 214, which is formed separately from the first chamber C1. The cartridge 200 may have formed therein an opening. One end of the insertion space 214 may be open to form the opening in the cartridge 200. The opening may expose the insertion space 214 to the outside.

The first container 210 may include an outer wall 211, which surrounds an inner space formed therein. The first container 210 may include an inner wall 212, which partitions the space surrounded by the outer wall 211 into the first chamber C1 on one side and the elongated insertion space 214 on another side. The insertion space 214 may have a shape that is elongated in the vertical direction. The inner wall 212 of the first container 210 may be formed inside the first container 210. A stick 400 (refer to FIG. 3) may be inserted into the insertion space 214.

The second container 220 may be coupled to the first container 210. The second container 220 may include a second chamber C2 communicating with the insertion space 214. The second chamber C2 may be formed in the second container 220. The second chamber C2 may be connected to the opposite end or the lower end of the insertion space 214.

One side of the cartridge 200 may be open to form a cartridge inlet 224. The outer wall of the second container 220 may be open to form the cartridge inlet 224. The cartridge inlet 224 may communicate with the insertion space 214. The cartridge inlet 224 may communicate with the second chamber C2. The cartridge inlet 224 may be formed in a side wall 221 of the second container 210.

The wick 261 may be disposed in the second chamber C2. The wick 261 may be connected to the first chamber C1. The wick 261 may receive liquid from the first chamber C1. The heater 262 may heat the wick 261. The heater 262 may be disposed in the second chamber C2. The heater 262 may be wound around the wick 261 multiple times. The heater 262 may be electrically connected to a battery 190 and/or a control device. The heater 262 may be a resistive coil. When the heater 262 generates heat and thus the wick 261 is heated, the liquid supplied to the wick 261 is atomized, and accordingly, an aerosol may be generated in the second chamber C2.

Accordingly, the first chamber C1 in the first container 210, in which the liquid is stored, may be disposed so as to surround the stick 400 (refer to FIG. 3) and/or the insertion space 214, into which the stick 400 is inserted, with the result that the efficiency of use of space for storing the liquid may be improved.

In addition, the distance from the stick 400 to the wick 261, which is connected to the first chamber C1, and the heater 262 may be reduced, thus making it possible to increase the efficiency of transfer of heat from the aerosol.

A printed circuit board (PCB) assembly 150 may be mounted in the column 140. At least one of a light source 153 or a sensor 154 may be mounted on a PCB 151 of the PCB assembly 150 (refer to FIG. 24). The PCB assembly 150 may be mounted so as to face the side portion of the cartridge 200. The light source 153 of the PCB assembly 150 may provide light to the cartridge 200. The sensor 154 of the PCB assembly 150 may sense information about the inside and the outside of the cartridge 200. The sensor 154 mounted on the PCB assembly 150 may be referred to as a first sensor 154.

A sensor 180 may be mounted on one side of the upper portion of the lower body 110. The sensor 180 may be disposed above a partition wall 112 of the lower body 110. The sensor 180 may sense the flow of air that is introduced into the cartridge 200. The sensor 180 may be an airflow sensor or a pressure sensor. The sensor 180 may be referred to as a second sensor 180.

The sensor 180 may be inserted into the mount 130. The sensor 180 may be disposed so as to face the side portion of the mount. The sensor 180 may be disposed adjacent to the cartridge inlet 224. The sensor 180 may be disposed so as to face the cartridge inlet 224.

The lower body 110 may accommodate the battery 190 therein. The lower body 110 may accommodate various control devices therein. The battery 190 may supply power to various components of the aerosol-generating device. The battery 190 may be charged through a charging port 119, which is formed in one side or the lower portion of the lower body 110.

The partition wall 112 of the lower body 110 may cover the upper portion of the battery 190. The partition wall 112 of the lower body 110 may be disposed below the mount 130 and/or the column 140. A body frame 114 of the lower body 110 may support the side portion of the battery 190. The body frame 114 may separate the space in which the battery 190 is accommodated from the space in which the control devices are accommodated. Referring to FIGS. 2 and 3, the stick 400 may have an elongated shape. The stick 400 may contain a medium therein. The stick 400 may be inserted into the insertion space 214.

A cover 310 may open and close the insertion space 214. The cover 310 may open and close an opening that exposes the insertion space 214 to the outside. The cover 310 may be mounted adjacent to the opening in the insertion space 214. The cover 310 may be mounted adjacent to one end or the upper end of the insertion space 214. For example, the cover 310 may be mounted to the upper end of the first container 210 at a position adjacent to the insertion space 214. For example, the cover 310 may be mounted to the cap 300 at a position adjacent to the insertion space 214.

The cover 310 may be pivotably mounted. The cover 310 may be pivoted to open and close the insertion space 214. The cover 310 may be pivoted toward the inside of the insertion space 214 to open the insertion space 214. The direction in which the cover 310 is pivoted to open the insertion space 214 may be referred to as a first direction. The cover 310 may be pivoted toward the outside of the insertion space 214 to close the insertion space 214. The direction in which the cover 310 is pivoted to close the insertion space 214 may be referred to as a second direction.

When an end of the stick 400 is brought into contact with the cover 310 and pushes the cover 310, the cover 310 may be pivoted in the first direction to open the insertion space 214. The stick 400 may push the cover 310, and may be inserted into the insertion space 214. When the stick 400 is separated from the insertion space 214, the cover 310 may be pivoted in the second direction to close the insertion space 214.

A spring 312 (refer to FIG. 12) may provide elastic force to the cover 310 in the second direction. One end of the spring 312 may support the cover 310, and the other end of the spring 312 may support the upper end of the first container 210 or the cap 300. The spring 312 may be wound around a pivot shaft of the cover 310.

The cover 310 may be mounted near the insertion hole 304 in the cap 300. The cover 310 may be pivotably mounted to the cap 300. The cover 310 may be pivoted to open and close the insertion hole 304. The cover 310 may be pivoted in the first direction to open the insertion hole 304. The cover 310 may be pivoted in the second direction to close the insertion hole 304.

The stick 400 may be inserted into the insertion space 214 through the insertion hole 304 in the cap 300. When the end of the stick 400 is brought into contact with the cover 310 and pushes the cover 310, the cover 310 may be pivoted in the first direction to open the insertion space 214 and the insertion hole 304. The stick 400 may push the cover 310, and may be inserted into the insertion space 214 through the insertion hole 304. When the stick 400 is separated from the insertion space 214, the cover 310 may be pivoted in the second direction to close the insertion space 214 and the insertion hole 304.

When the stick 400 is inserted into the insertion space 214, one end of the stick 400 may be exposed to the outside of the cap 300, and the other end of the stick 400 may be disposed above the second chamber C2 at a position adjacent to the second chamber C2. The user may hold the exposed end of the stick 400 in the mouth, and may inhale air.

Air may be introduced into the aerosol-generating device through the cap inlet 304*a*. The air introduced through the cap inlet 304*a* may flow into the cartridge inlet 224. The air may flow into the cartridge 200 through the cartridge inlet 224. The air that has passed through the cartridge inlet 224 may be introduced into the second chamber C2, and may then flow toward the insertion space 214. The air may pass through the stick 400 together with the aerosol generated in the second chamber C2.

As described above, when the stick 400 is inserted into the insertion space 214, the insertion space 214 may be opened by the pivoting movement of the cover 310.

In addition, simultaneously with separation of the stick 400 from the insertion space 214, the insertion space 214 may be automatically closed by the pivoting movement of the cover 310.

In addition, the inside of the insertion space 214 may be protected from external foreign substances.

Referring to FIGS. 4 to 6, the cartridge 200 may be detachably coupled to the upper body 120. The upper body 120 may be disposed on the lower body 110. The upper body 120 may include at least one of the mount 130 or the column 140.

The mount 130 may provide a space 134 having an open top. The inner side surface 131 and the bottom 133 of the mount 130 may surround at least a portion of the space 134. The inner side wall 141 of the column 140 may surround one side of the space 134. The second container 220 may be inserted into the space 134 provided by the mount 130. The mount 130 may surround the second container 220 inserted into the space 134.

The cartridge 200 may be coupled to the mount 130 in a snap-fit manner. The second container 220 may be coupled to the mount 130 in a snap-fit manner. The second container 220 may be detachably engaged with the mount 130. When the second container 220 is inserted into the space 134 in the mount 130, a depressed portion 221*a* formed in the second container 220 and a protruding portion 131*a* formed on the mount 130 may be engaged with each other.

The depressed portion 221*a* may be formed so as to be recessed into the side wall 221 of the second container 220. The depressed portion 221*a* may be formed in a plural number, and the plurality of depressed portions 221*a* may be respectively formed in one side and the opposite side of the side wall 221 of the container 220. The protruding portion 131*a* may be formed so as to protrude from the inner side surface 131 of the mount 130. The protruding portion 131*a* may be provided in a plural number, and the plurality of protruding portions 131*a* may be respectively formed on one side and the opposite side of the inner side surface 131 of the mount 130. The protruding portions 131*a* may be formed at positions corresponding to the depressed portions 221*a*.

When the second container 220 is coupled to the mount 130, the first container 210 may be disposed on the mount 130. The first container 210 may have a shape that protrudes further in a lateral direction than the second container 220. The second container 220 may be inserted into the space 134 surrounded by the mount 130, and the first container 210 may cover the upper portion of the mount 130.

The mount 130 may support the lower portion of the cartridge 200. The mount 130 may support the side portion and the bottom of the second container 220. The mount 130 may support the lower edge of the first container 210.

The column 140 may extend upwards from one side of the mount 130. The column 140 may surround one side of the space 134 in the mount 130. The inner side wall 141 of the column 140 may be integrally formed with and extend from the inner side surface 131 of the mount 130. The outer side wall 142 of the column 140 may be integrally formed with and extend from the outer side surface 132 of the mount 130.

The column 140 may extend to a height corresponding to the height of the cartridge 200. The upper wall 143 of the column 140 may be formed to a height corresponding to the upper end of the cartridge 200. The column 140 may be formed parallel to the cartridge 200.

The insertion space 214 in the cartridge 200 may be formed adjacent to one side wall of the cartridge 200. The insertion space 214 may be formed adjacent to the column 140. The column 140 may cover the side wall of the cartridge 200, in which the insertion space 214 is formed. The side wall of the cartridge 200 may slide along the inner side wall 141 of the column 140, and may be inserted into the mount 130. The column 140 may support the side wall of the cartridge 200.

A window 170, which protects the PCB assembly 150 (refer to FIG. 3), may be disposed so as to cover the inner side wall 141 of the column 140. The window 170 may be disposed between the cartridge 200 and the column 140. The window 170 may extend in the vertical direction along the column 140. The window 170 may cover one side wall of the cartridge 200, in which the insertion space 214 is formed. The window 170 may support the side wall of the cartridge 200.

Accordingly, the cartridge 200 may be detachably coupled to the body 100.

In addition, the cartridge 200 may be coupled to the body 100, and may thus be stably supported thereby.

Referring to FIGS. 7 to 11, the cap 300 may be detachably coupled to the body 100. The cap 300 may protect the cartridge 200 and a portion of the body 100 from the outside. The user may separate the cap 300 from the body in order to replace the cartridge 200.

The upper body 120 may have coupling protrusions 132*a* and 132*b* formed on the outer side surfaces 132 and 142 thereof. The coupling protrusions 132*a* and 132*b* may be formed on the outer side surface 132 of the mount 130. The coupling protrusions 132*a* and 132*b* may be formed on the outer side wall 142 of the column 140. The coupling protrusions 132*a* and 132*b* may include a first coupling protrusion 132*a* and a second coupling protrusion 132*b*. The first coupling protrusion 132*a* and the second coupling protrusion 132*b* may be arranged vertically relative to each other.

The first coupling protrusion 132*a* may be formed so as to protrude outwards from the outer side surface of the upper body 120. The first coupling protrusion 132*a* may be provided in a plural number. One of the plurality of first coupling protrusions 132*a* may be formed so as to protrude outwards from the outer side surface 132 of the mount 130. This first coupling protrusion 132*a* may be formed at a position opposite the column 140. The other of the plurality of first coupling protrusions 132*a* may be formed so as to protrude outwards from the outer side wall 142 of the column 140.

The first coupling protrusion 132*a* may protrude further outwards than the second coupling protrusion 132*b*. The first coupling protrusion 132*a* may be disposed below the second coupling protrusion 132*b*. The first coupling protrusion 132*a* may be narrower than the second coupling protrusion 132*b*. The first coupling protrusion 132*a* may have a shape in which the width thereof in the lateral direction is relatively small. The first coupling protrusion 132*a* may have a shape in which the width thereof gradually decreases from the lower side thereof toward the upper side thereof.

The second coupling protrusion 132*b* may be formed so as to protrude outwards from the outer side surface of the upper body 120. The second coupling protrusion 132*b* may protrude in a convex or round shape. The second coupling protrusion 132*b* may be provided in a plural number. One of the plurality of second coupling protrusions 132*b* may be formed so as to protrude outwards from the outer side surface 132 of the mount 130. This second coupling protrusion 132*b* may be formed at a position opposite the column 140. This second coupling protrusion 132*b* may have a shape that is elongated along the circumference of the outer side surface 132 of the mount 130. The other of the plurality of second coupling protrusions 132*b* may be formed so as to protrude outwards from the outer side wall 142 of the column 140. This second coupling protrusion 132*b* may have a shape that is elongated along the circumference of the outer side wall 142 of the column 140.

Coupling recesses 302*a* and 302*b* may be formed in the inner side surface 302 of the cap 300. The coupling recesses 302*a* and 302*b* may be formed at positions corresponding to the coupling protrusions 132*a* and 132*b*. When the cap 300 covers the cartridge 200 and the upper body 120, the coupling protrusions 132*a* and 132*b* may be fitted into the coupling recesses 302*a* and 302*b*, and accordingly, the cap 300 may be coupled to the upper body 120. The coupling recesses 302*a* and 302*b* may include a first coupling recess 302*a* and a second coupling recess 302*b*. The first coupling recess 302*a* and the second coupling recess 302*b* may be arranged vertically relative to each other.

The first coupling recess 302*a* may be formed so as to be recessed outwards in the inner side surface 302 of the cap 300. The first coupling recess 302*a* may be formed in the inner side surface 302 of the cap 300 at a position corresponding to the first coupling protrusion 132*a*. The first coupling recess 302*a* may be formed in a plural number. The first coupling recesses 302*a* may have a shape in which the width thereof gradually decreases toward the upper side thereof. The first coupling protrusion 132*a* may be inserted into the first coupling recess 302*a*. When the first coupling protrusion 132*a* is inserted into the first coupling recess 302*a*, the first coupling protrusion 132*a* and the first coupling recess 302*a* may guide placement of the cap 300 at the correct position.

The second coupling recess 302*b* may be formed so as to be recessed outwards in the inner side surface 302 of the cap 300. The second coupling recess 302*b* may be recessed in a convex or round shape. The second coupling recess 302*b* may be formed in the inner side surface 302 of the cap 300 at a position corresponding to the second coupling protrusion 132*b*. The second coupling recess 302*b* may be formed in a plural number. The second coupling recesses 302*b* may have a shape that is elongated along the circumference of the inner side surface 302 of the cap 300. The second coupling protrusion 132*b* may be inserted into and engaged with the second coupling recess 302*b* in a snap-fit manner. The second coupling protrusion 132*b* and the second coupling recess 302*b* may be detachably engaged with each other.

An upper edge 113 of the lower body 110 may protrude further outwards than the upper body 120. The upper edge 113 of the lower body 110 may extend along the circumference of the upper body 120. The upper edge 113 of the lower body 110 may be disposed below the upper body 120. When the cap 300 is coupled to the body 100, the lower end of the side wall 301 of the cap 300 may be brought into contact with the upper edge 113 of the lower body 110. The upper edge 113 of the lower body 110 may prevent the cap 300 from moving to a position below the upper body 120.

Referring to FIGS. 12 and 13, the cap 300 may include at least one of a cap body 320, a lower head 330, or an upper head 340. The cover 310 may be pivotably mounted to the cap 300. The cover 310 may be disposed so as to close the insertion hole 304. The cover 310 may have a plate shape. The cover 310 may include a peripheral portion formed to be round along the circumference of the insertion hole.

A shaft 311 may be formed at an end of the cover 310. The shaft 311 may be integrally formed with the cover 310. The shaft 311 may have a shape that is elongated in one direction. The cover 310 may pivot about the direction in which the shaft 311 extends. The shaft 311 may function as a pivot shaft of the cover 310. The shaft 311 may protrude from the end of the cover 310 in two opposite directions. The shaft 311 may be referred to as a cover shaft 311.

The spring 312 may be coupled to the cover 310. One end of the spring 312 may support the cover 310, and the other end of the spring 312 may support one side of the cap 300 (refer to FIGS. 17 and 18). The other end of the spring 312 may support the upper head 340. The spring 312 may move the cover 310 in the second direction using the elastic force or the restoring force thereof. The cover 310 may be moved in the second direction by the spring 312, thereby closing the insertion space 214 (refer to FIG. 17) and/or the insertion hole 304. The spring 312 may be wound around the shaft 311. One end of the spring 312 wound around the shaft 311 may extend toward the cover 310, and the other end thereof may extend in a direction opposite the one end thereof.

The cap body 320 may form the side wall 301 of the cap 300. The cap body 320 may have a vertically open and hollow shape. The cap body 320 may cover the side portion of the cartridge 200 and the side portion of the upper body 120. The cap body 320 may include a coupling rib 322. The coupling rib 322 may be formed so as to protrude inwards from the inner side surface 302 of the cap body 320. The coupling rib 322 may have a shape that extends along the circumference of the side wall 301 of the cap body 320. The coupling rib 322 may be formed at the upper portion of the cap body 320.

The coupling rib 322 may have formed therein at least one of a first rib recess 323 or a second rib recess 324. The first rib recess 323 may be formed so as to be recessed outwards in the coupling rib 322. The first rib recess 323 may be formed in one side of the coupling rib 322. The second rib recess 324 may be formed in a manner such that the lower portion of the coupling rib 322 is recessed upwards. The second rib recess 324 may be formed in a plural number, and the plurality of second rib recesses 324 may be arranged along the circumference of the coupling rib 322.

The lower head 330 and the upper head 340 may be coupled to each other in the vertical direction to form the upper portion of the cap 300. The lower head 330 may be coupled to the lower side of the upper head 340. The lower head 330 may surround the lower side of the insertion hole 304.

The lower head 330 may have shaft recesses 331 formed therein. The shaft recesses 331 may be formed in two opposite sides of the lower head 330. The shaft recesses 331 may have a shape that is concavely recessed downwards. The shaft 311 may be rotatably inserted into the shaft recesses 331. Each of the two opposite ends of the shaft 311 may be inserted into a respective one of the pair of shaft recesses 331.

The lower head 330 may include a head rib 332. The head rib 332 may have a shape that extends along the circumference of the lower head 330. The head rib 332 may be disposed below the coupling rib 322. The head rib 332 may catch on the lower portion of the coupling rib 322.

The lower head 330 may include a first head latch 333. The head latch 333 may be formed so as to protrude upwards from the head rib 332. When the head rib 332 is disposed adjacent to the lower side of the coupling rib 322, the head latch 333 may catch on the upper portion of the coupling rib 322.

The lower head 330 may include a guide bar 335. The guide bar 335 may be formed on one side of the head rib 332. The guide bar 335 may have a shape that is elongated upwards. When the head rib 332 is disposed adjacent to the lower side of the coupling rib 322, the guide bar 335 may be inserted into the first rib recess 323. The guide bar 335 may be inserted into the first rib recess 323, thereby guiding the disposition of the lower head 330. A screw 334 may fix the lower head 330 and the upper head 340 to each other. The screw 334 may penetrate the lower portion of the lower head 330, and may be fixed to the upper head 340.

The cap 300 may include a second guide 306. The second guide 306 may be formed at the lower head 330. The second guide 306 may be formed near the insertion hole 304. The second guide 306 may be disposed below the insertion hole 304. The second guide 306 may be disposed between the insertion hole 304 and the insertion space 214. The second guide 306 may be formed so as to be inclined downwards. The second guide 306 may extend from a portion near the insertion hole 304 in the cap 300 so as to be inclined toward one end or the upper end of the insertion space 214 (refer to FIG. 17).

The upper head 340 may be coupled to the upper portion of the cap body 320 to form the upper wall 303 of the cap 300. The upper wall 303 of the cap 300 may be referred to as an upper head wall 303. The upper head 340 may be coupled to the upper side of the lower head 330. The circumference of the upper head wall 303 may catch on the upper side of the coupling rib 322.

The upper head 340 may include a second head latch 343. The second head latch 343 may be formed so as to protrude downwards from the circumference of the upper head wall 303. When the circumference of the upper head wall 303 catches on the coupling rib 322, the second head latch 343 may be engaged with the second rib recess 324 formed in the coupling rib 322.

The cap 300 may have formed therein the insertion hole 304, which communicates with one end of the insertion space 214. The cap 300 may include an insertion hole wall 305, which defines the circumference of the insertion hole 304. A portion of the upper head wall 303 of the cap 300 may be open to form the insertion hole 304. The insertion hole wall 305 may have a shape that extends in a circumferential direction. The inner circumferential surface of the insertion hole wall 305 may surround the circumference of the insertion hole 304.

The inner circumferential surface of the insertion hole wall 305 may be formed to be round. The inner circumferential surface of the insertion hole wall 305 may be formed to be convex inwards. The inner circumferential surface of the insertion hole wall 305 may have a shape that gradually narrows the insertion hole 304 and then gradually widens the insertion hole 304 from the upper side thereof toward the lower side thereof.

An end portion or the circumference of the cover 310 may catch on the lower side of the insertion hole wall 305. When the cover 310 closes the insertion hole 304, the insertion hole wall 305 may come into contact with the cover 310, thereby restricting the movement of the cover 310. The insertion hole wall 305 may come into contact with the end portion or the circumference of the cover 310, thereby preventing the cover 310 from pivoting to a position above the insertion hole 304. The cover 310 may be larger than the insertion hole 304.

Referring to FIGS. 14 and 15, the cartridge 200 may have a cover recess 215 formed therein. The cover recess 215 may be adjacent to the opening in the insertion space 214. The cover recess 215 may be recessed from the insertion space 214 in the direction in which the circumference of the insertion space 214 expands. The cover recess 215 may be recessed outwards from the insertion space 214. The cover recess 215 may be recessed from the insertion space 214 in a radially outward direction. The cover recess 215 may be recessed from the insertion space 214 toward the first chamber C1. The cover recess 215 may provide space in which to place the cover 310.

The cover recess 215 may be formed in the first container 210 at a position near one end or the upper end of the insertion space 214. The cover recess 215 may be formed in a manner such that the circumference of the end portion of the insertion space 214 is recessed outwards. The cover 310 may be received in the cover recess 215 (refer to FIGS. 17 and 18). When the cover 310 opens the opening in the insertion space 214, the cover 310 may be received in the cover recess 215. When the cover 310 opens the opening in the insertion space 214, the cover 310 may pivot in the first direction to be received in the cover recess 215.

The cover recess 215 may be formed in a manner such that one end portion or the upper end portion of the inner wall 212 of the first container 210 is recessed outwards from the insertion space 214. The cover recess 215 may be formed in a manner such that the inner wall 212 of the first container 210 is recessed from the insertion space 214 toward the first chamber C1. The inner wall 212 of the first container 210 may define the cover recess 215. The inner wall 212 of the first container 210 may surround at least a portion of the cover recess 215. The inner wall 212 of the first container 210 may be contiguous with the bottom of the cover recess 215. The inner wall 212 of the first container 210 may cover a part of the side portion of the cover recess 215.

The cartridge 200 may include a first guide 216, which is formed at a position adjacent to the upper portion of the insertion space 214 so as to be inclined in the downward direction of the insertion space 214. The first guide 216 may be formed at the upper end portion of the inner wall 212 of the first container 210. The first guide 216 may be referred to as a first stick guide 216.

The first guide 216 may be contiguous with the bottom of the cover recess 215. The first guide 216 may be formed on the inner wall 212 of the first container 210 at a position that is contiguous with the bottom of the cover recess 215. The first guide 216 may be formed between the bottom of the cover recess 215 and the insertion space 214. The first guide 216 may be disposed below the cover recess 215. The first guide 216 may be formed so as to be inclined from the bottom of the cover recess 215 toward the lower side of the insertion space 214.

The first guide 216 may extend in the circumferential direction along at least a portion of the insertion space 214. The first guide 216 may extend in the circumferential direction along the inner wall 212 of the first container 210. The first guide 216 may come into contact with an end portion of the stick 400 (refer to FIG. 3), and may guide insertion of the stick 400 into the insertion space 214.

Referring to FIG. 15, the cartridge 200 may include at least one of a first container 210, a second container 220, a sealing member 250, a wick 261, or a heater 262. The second container 220 may include at least one of a lower case 230 or a frame 240.

The first container 210 may provide the first chamber C1 and the insertion space 214. The inner wall 212 of the first container 210 may partition the space surrounded by the outer wall 211 of the first container 210 into the first chamber C1 on one side and the insertion space 214 on another side.

The outer wall 211 and the inner wall 212 of the first container 210 may surround the side portion of the first chamber C1. The outer wall 211 and the inner wall 212 of the first container 210 may be connected to each other so as to have an extended shape that surrounds the circumference of the first chamber C1. The upper wall 213 of the first container 210 may cover the upper portion of the first chamber C1. The upper wall 213 of the first container 210 may be connected to the outer wall 211 and the inner wall 212 of the first container 210.

The outer wall 211 and the inner wall 212 of the first container 210 may surround the side portion of the insertion space 214. The insertion space 214 may have a shape that is elongated in the vertical direction. The insertion space 214 may have a shape corresponding to the circumference of the stick 400 (refer to FIG. 3). The insertion space 214 may have a substantially cylindrical shape. The outer wall 211 and the inner wall 212 of the first container 210 may be connected to each other, and may thus have a shape that extends in the circumferential direction so as to surround the circumference of the insertion space 214. The insertion space 214 may have open upper and lower end portions.

The second container 220 may provide the second chamber C2. The second chamber C2 may be disposed below the insertion space 214. The second chamber C2 may communicate with the insertion space 214.

The second container 220 may include at least one of a lower case 230 or a frame 240. The lower case 230 may form the external appearance of the second container 220. The lower case 230 may be coupled to the outer wall 211 or the circumference of the first container 210. The lower case 230 may provide an accommodation space therein. The lower case 230 may support the frame 240. The side wall of the lower case 230 may be open to form the cartridge inlet 224. The cartridge inlet 224 may be formed at a position higher than the bottom of the lower case 230.

Accordingly, it is possible to prevent the liquid in the second chamber C2 from leaking out of the cartridge 200 through the cartridge inlet 224.

The lower case 230 may include at least one of an accommodation portion 231 or an extension portion 232. The accommodation portion 231 may provide an accommodation space therein. The accommodation portion 231 may surround the accommodation space. The accommodation portion 231 may accommodate at least a portion of the frame 240 therein. The side wall of the accommodation portion 231 may be the side wall 221 of the second container 220 (refer to FIG. 4). The side wall of the accommodation portion 231 may be open to form the cartridge inlet 224. The extension portion 232 may extend outwards from the upper end of one side of the accommodation portion 231. The extension portion 232 may support a portion of the frame 240. The accommodation portion 231 may be referred to as a case portion 231.

The frame 240 may be disposed in the lower case 230. The frame 240 may define the second chamber C2. The frame 240 may surround at least a portion of the second chamber C2. The lower case 230 may surround the remaining portion of the second chamber C2. The frame 240 may form the bottom of the first chamber C1.

The frame 240 may include at least one of a first frame portion 241 or a second frame portion 242. The first frame portion 241 may form the bottom of the first chamber C1. The first chamber C1 may be surrounded by the outer wall 211, the inner wall 212, the upper wall 213, and the first frame portion 241 of the first container 210.

The second frame portion 242 may surround at least a portion of the second chamber C2. The second frame portion 242 may define the second chamber C2. The side wall of the second frame portion 242 may surround at least a part of the side portion of the second chamber C2. The bottom of the second frame portion 242 may form the bottom of the second chamber C2. A chamber inlet 2424 may be formed in the side wall of the second frame portion 242. The chamber inlet 2424 may communicate with the second chamber C2. The second frame portion 242 may be disposed adjacent to the lower side of the inner wall 212 of the first container 210. The chamber inlet 2424 may be formed at a position higher than the bottom of the second chamber C2.

The first frame portion 241 and the second frame portion 242 may be connected to each other. The first frame portion 241 may extend from the second frame portion 242 so as to cover the bottom of the first chamber C1.

The accommodation portion 231 may accommodate the second frame portion 242 therein. The accommodation portion 231 may support the bottom of the second frame portion 242. The accommodation portion 231 may define the second chamber C2 together with the second frame portion 242. The extension portion 232 may support the first frame portion 241. The second frame portion 242 may be disposed in the accommodation portion 231, and the first frame portion 241 may be disposed on the extension portion 232.

A connection passage 2314 may be formed in the accommodation portion 231. The frame 240 may define the connection passage 2314 in the lower case 230. The connection passage 2314 may be formed between the cartridge inlet 224 and the chamber inlet 2424 to interconnect the cartridge inlet 224 and the chamber inlet 2424. The first frame portion 241 may cover the upper portion of the connection passage 2314. The second frame portion 242 may cover the side portion of the connection passage 2314.

A blocking wall 2317 may be formed in the connection passage 2314. The blocking wall 2317 may be formed between the cartridge inlet 224 and the chamber inlet 2424. The blocking wall 2317 may have an elongated shape. The blocking wall 2317 may extend upwards from the bottom of the lower case 230 or the bottom of the frame 240. The blocking wall 2317 may extend to a position higher than the cartridge inlet 224. The blocking wall 2317 may extend to a position higher than the chamber inlet 2424.

Accordingly, it is possible to prevent the liquid in the second chamber C2 from leaking out of the cartridge 200 through the cartridge inlet 224.

A sealing member 250 may be disposed between the first chamber C1 and the second container 220. The sealing member 250 may surround and be in close contact with the edge of the first chamber C1. The sealing member 250 may be made of an elastic material. For example, the sealing member 250 may be made of a material such as rubber or silicon. The sealing member 250 may prevent the liquid stored in the first chamber C1 from leaking from the first chamber C1 into gaps between components.

The sealing member 250 may include at least one of a first sealing portion 251 or a second sealing portion 252. The first sealing portion 251 may extend along the outer wall 211 of the first container 210. The first sealing portion 251 may surround the edge of the outer wall 211 of the first container 210. The first sealing portion 251 may be disposed between and be in close contact with the outer wall 211 of the first container 210 and the frame 240. The first sealing portion 251 may be disposed between and be in close contact with the outer wall 211 of the first container 210 and the first frame portion 241.

Accordingly, it is possible to prevent the liquid stored in the first chamber C1 from leaking through the gap between the outer wall 211 of the first container 210 and the frame 240.

The second sealing portion 252 may extend from the first sealing portion 251 along the inner wall 212 of the first container 210. The second sealing portion 252 may surround and be in close contact with the edge of the inner wall 212 of the first container 210. The second sealing portion 252 may be disposed between and be in close contact with the inner wall of the first container 210 and the frame 240. The second sealing portion 252 may be disposed between and be in close contact with the inner wall of the first container 210 and the second frame portion 242. The second sealing portion 252 may be inserted into the frame 240. The second sealing portion 252 may be inserted into the second frame portion 242. The lower end of the inner wall 212 of the first container 210 may press the second sealing portion 252 toward the frame 240.

Accordingly, it is possible to prevent the liquid stored in the first chamber C1 from leaking into the gap between the inner wall 212 of the first container 210 and the frame 240.

The mount 130 may include a sensor accommodation portion 137. The sensor accommodation portion 137 may provide space that is formed at the lower portion of one side wall of the mount 130. The second sensor 180 may be accommodated in the sensor accommodation portion 137. The lower case 230 may cover the sensor accommodation portion 137. The lower case 230 may surround one side of the sensor accommodation portion 137. One side wall of the accommodation portion 231 of the lower case 230 may face the side portion of the sensor accommodation portion 137. The extension portion 232 of the lower case 230 may cover the upper portion of the sensor accommodation portion 137.

A gap through which air flows may be formed between the sensor accommodation portion 137 and the lower case 230. Air may pass through the gap between the sensor accommodation portion 137 and the lower case 230, and may be introduced into the cartridge inlet 224. The second sensor 180 may sense the flow of air into the cartridge inlet 224 through the gap between the sensor accommodation portion 137 and the lower case 230.

Referring to FIGS. 15 and 16, the cartridge 200 may include a stick stopper 217, which protrudes inwards from the circumference of the insertion space 214 at a position adjacent to the opposite end or the lower end of the insertion space 214. The stick stopper 217 may protrude in the radially inward direction. The stick stopper 217 may be formed on the outer wall 211 and/or the inner wall 212 of the first container 210.

The stick stopper 217 may be provided in a plural number. Three stick stoppers 217 may be provided. A plurality of stick stoppers 217 may be arranged along the circumference of the insertion space 214. The stick stoppers 217 may be arranged in the circumferential direction. The stick stoppers 217 may be spaced apart from each other. The stick stoppers 217 may be formed in the shape of a rib or a ring that extends in the circumferential direction along the circumference of the insertion space 214. The stick 400 may be seated over the stick stoppers 217. The stick stoppers 217 may have a shape that gradually widens in the upward direction.

Accordingly, when the stick 400 is inserted into the insertion space 214, the end of the stick 400 may be brought into contact with the stick stoppers 217, with the result that the stick 400 may be prevented from moving to the second chamber C2 beyond the insertion space 214.

In addition, it is possible to minimize a reduction in the amount of air flowing from the second chamber C2 to the insertion space 214.

In addition, the stick stoppers 217 may not impede the aerosol generated in the second chamber C2 from extracting a certain component from the medium in the stick 400.

Referring to FIGS. 17 and 18, the pivot shaft or the shaft 311 of the cover 310 may be disposed above the insertion space 214. The pivot shaft or the shaft 311 of the cover 310 may be disposed between the insertion space 214 and the insertion hole 304. The cover 310 may be pivoted toward the inside of the insertion space 214 to open the insertion space 214 and/or the insertion hole 304. The direction in which the cover 310 is pivoted toward the inside of the insertion space 214 may be defined as a first direction.

When the cover 310 is pivoted in the first direction to open the insertion space 214, the cover 310 may be received in the cover recess 215. When the cover 310 opens the insertion space 214, the cover 310 may be received in the cover recess 215, and may overlap the inner wall 212 of the first container 210, which is disposed below the cover recess 215. When the cover 310 opens the insertion space 214, the cover 310 may be disposed parallel to the inner wall 212 of the first container 210, which is located below the cover recess 215.

The first guide 216 may be formed so as to be inclined from the bottom of the cover recess 215 toward the lower side of the insertion space 214. The first guide 216 may be formed so as to be inclined such that the insertion space 214 is gradually narrowed toward the lower side thereof. When the cover 310 opens the insertion space 214, the first guide 216 may be disposed adjacent to one end of the cover 310 at a position below the cover 310. When the cover 310 opens the insertion space 214, the first guide 216 may protrude toward the insertion space 214 further than the end of the cover 310.

The cover 310 may be pivoted toward the outside of the insertion space 214 to close the insertion space 214 and/or the insertion hole 304. The direction in which the cover 310 is pivoted toward the outside of the insertion space 214 may be defined as a second direction. One end of the spring 312 may support the cover 310, and the other end of the spring 312 may support the cap 300. The spring 312 may provide elastic force to the cover 310 in the direction in which the cover 310 closes the insertion space 214. The cover 310 may be pivoted in the second direction by the spring 312.

The second guide 306 may be formed so as to be inclined such that the inner space is gradually narrowed toward the lower side thereof. The second guide 306 may be disposed adjacent to the pivoting radius of the cover 310. The second guide 306 may be disposed outside the pivoting radius of the cover 310. The second guide 306 may extend so as to be inclined along the pivoting radius of the cover 310.

One end of the second guide 306 may be adjacent to the insertion hole 304. The end of the second guide 306 may be disposed outside the insertion hole 304. The end of the second guide 306 may be disposed below the insertion hole wall 305. The insertion hole wall 305 may protrude further inwards than the end of the second guide 306. When the cover 310 is pivoted in the second direction to close the insertion space 214, the cover 310 may be brought into contact with the insertion hole wall 305, and thus movement thereof may be restricted.

The other end of the second guide 306 may be adjacent to the insertion space 214. The other end of the second guide 306 may be adjacent to the outer wall 211 of the first container 210, which forms the circumference of the insertion space 214. The other end of the second guide 306 may be disposed above the outer wall 211 of the first container 210, which defines the insertion space 214. The second guide 306 may have a shape that extends so as to be inclined from one end thereof to the other end thereof.

Referring to FIGS. 19 to 22, the stick 400 may push the cover 310 in the inward direction of the insertion space 214 or in the first direction. When the stick 400 pushes the cover 310 and is inserted into the insertion space 214, the cover 310 may open the insertion space 214 and/or the insertion hole 304.

Referring to FIGS. 19 and 20, when the end of the stick 400 passes through the insertion hole 304, the end of the stick 400 may be brought into contact with the insertion hole wall 305. When the end of the stick 400 is brought into contact with the insertion hole wall 305, the insertion hole wall 305 may guide the stick 400 to the correct position in the insertion hole 304. After passing through the insertion hole 304, the end of the stick 400 may push the cover 310 so that the cover 310 is pivoted in the first direction.

Referring to FIGS. 20 and 21, when the stick 400 completely passes through the insertion hole 304, the cover 310 may be received in the cover recess 215. The cover 310 may overlap the inner wall 212 of the first container 210, thereby forming one side wall of the insertion space 214 together with the inner wall 212 of the first container 210.

Referring to FIGS. 21 and 22, the stick 400 may slide along the surface of the cover 310, and may be inserted into the insertion space 214. The second guide 306 may be disposed at a position opposite the pivot shaft of the cover 310 with respect to the insertion hole 304. The second guide 306 may be disposed at a position opposite the cover recess 215. When the stick 400 is inserted into the insertion space 214, the end of the stick 400 may be brought into contact with the second guide 306. When the end of the stick 400 is brought into contact with the second guide 306, the second guide 306 may guide the stick 400 to the correct position in the insertion space 214.

The first guide 216 may be disposed at a position opposite the second guide 306. The first guide 216 may be disposed below the second guide 216. The first guide 216 may be disposed below the cover recess 215. The first guide 216 may be disposed below the cover 310. The first guide 216 may extend in the circumferential direction along the inner wall 212 of the first container 210. When the stick 400 is inserted into the insertion space 214, the end of the stick 400 may be brought into contact with the first guide 216. After being guided to the correct position by contact with the second guide 306, the end of the stick 400 may be brought into contact with the first guide 216. When the end of the stick 400 is brought into contact with the first guide 216, the first guide 216 may guide the stick 400 to the correct position in the insertion space 214.

The end of the stick 400 inserted into the insertion space 214 may be brought into contact with the stick stopper 217. The stick stopper 217, with which the end of the stick 400 comes into contact, may prevent the stick 400 from moving to a region below the insertion space 214 or to the second chamber C2.

Accordingly, when the user pushes the cover 310 using the stick 400, the stick 400 may be guided to the correct position so as to smoothly pass through the insertion hole 304 and to push the cover 310.

In addition, when the stick 400 pushes the cover 310 and thus the cover 310 is disposed in the insertion space 214, the cover 310 is received in the cover recess 215, so the stick 400 may be brought into close contact with the wall defining the insertion space 214.

In addition, since the stick 400 is in close contact with the wall defining the insertion space 214, when the user inhales air through the stick 400, it is possible to prevent unnecessary flow of air between the insertion space 214 and the stick 400 and to reduce waste of inhalation force, thereby preventing deterioration in air flow efficiency.

In addition, even though the cover 310 applies external force to the end of the stick 400 in the second direction when the user pushes the cover 310 using the stick 400, the stick 400 may be guided so as to be correctly inserted into the insertion space 214.

In addition, it is possible to prevent the stick 400 from moving to the inside of the second chamber C2.

Referring to FIG. 23, the upper body 120 may be coupled to the upper portion of the lower body 110. The mount 130 may cover the upper portion of the lower body 110. The lower portion of the mount 130 may be surrounded by the upper portion of the side wall 111 of the lower body 110. The mount 130 may be coupled to the upper portion of the lower body 110. The mount 130 may be coupled to the lower body 110 in a snap-fit manner. The mount 130 may be engaged with the lower body 110 so as not to be separated therefrom.

The second sensor 180 may be disposed on one side of the upper portion of the lower body 110. A sensor support portion 185 may have a shape that extends upwards from the upper portion of the lower body 110. The sensor support portion 185 may support the second sensor 180. The second sensor 180 may be coupled to the sensor support portion 185. The second sensor 180 may be coupled to the sensor support portion 185 so as to be oriented in the lateral direction. The sensor accommodation portion 137 of the mount 130 may accommodate and cover the second sensor 180 and the sensor support portion 185.

Referring to FIGS. 24 to 26, a fastening hole 135 may be formed in the lower portion of the mount 130. The fastening hole 135 may be formed at a side part of the lower portion of the mount 130. The fastening hole 135 may be formed in a plural number, and the plurality of fastening holes 135 may be arranged along the circumference of the lower portion of the mount 130. A body latch 115 provided at the upper portion of the lower body 110 may be inserted into the fastening hole 135, whereby the mount 130 and the lower body 110 may be engaged with each other (refer to FIGS. 28 and 29).

A rib groove 136 may be formed in the outer side surface 132 of the mount 130. The rib groove 136 may have a shape that is recessed inwards from the outer side surface 132 of the mount 130. The rib groove 136 may have a shape that extends along the circumference of the outer side surface 132 of the mount 130. A body rib 116, which extends along the inner circumference of the upper portion of the lower body 110, may be inserted into the rib groove 136, whereby the mount 130 and the lower body 110 may be engaged with each other. The body rib 116 may be made of an elastic material. For example, the body rib 116 may be made of a material such as rubber or silicon. The body rib 116 may be in close contact with the rib groove 136. Accordingly, the position of the mount 130 may be reliably fixed to the lower body 110, and the upper body 120 may be prevented from shaking relative to the lower body 110 (refer to FIGS. 28 and 29).

A first fixing portion 138 may be formed at the lower portion of the mount 130. The first fixing portion 138 may be formed so as to be recessed upwards or to protrude downwards from the lower portion of the mount 130. The first fixing portion 138 may be formed at the circumference of the lower portion of the mount 130. The first fixing portion 138 may be formed in a plural number, and the plurality of first fixing portions 138 may be arranged along the circumference of the lower portion of the mount 130. A second fixing portion 118, which is provided at the upper portion of the lower body 110, may be coupled to the first fixing portion 138. Accordingly, the position of the mount 130 may be reliably fixed to the lower body 110, and the upper body 120 may be prevented from shaking relative to the lower body 110 (refer to FIGS. 28 and 29).

The upper body 120 may include the column 140, which extends upwards. The column 140 may extend upwards from one side of the mount 130. The side walls 141 and 142 of the column 140 may be connected to the side walls 131 and 132 of the mount 130. The column 140 may cover a portion of the space 134 provided by the mount 130. The inner wall 141 of the column 140 may have a shape that is concavely recessed outwards. The column 140 may face the side portion of the cartridge 200 (refer to FIG. 6). The column 140 may cover one side portion of the cartridge 200. The column 140 may be open toward one side portion of the cartridge 200.

The column 140 may accommodate the PCB assembly 150. The PCB assembly 150 may provide light to the cartridge 200, or may sense information about the cartridge 200. For example, the information about the cartridge 200 may include at least one of information about a change in the remaining amount of liquid stored in the first chamber C1 in the cartridge 200, information about the type of liquid stored in the first chamber C1 in the cartridge 200, information about whether the stick 400 is inserted into the insertion space 214 in the cartridge 200, information about the type of stick 400 inserted into the insertion space 214 in the cartridge 200, information about the extent of use or the availability of the stick 400 inserted into the insertion space 214 in the cartridge 200, information about whether the cartridge 200 having the stick 400 inserted into the insertion space 214 is coupled to the body 100, or information about the type of cartridge 200 coupled thereto. The information about the cartridge 200 is not limited to the aforementioned information. The column 140 may accommodate a light source 153 configured to emit light. The column 140 may accommodate a first sensor 154 configured to sense information about the cartridge 200.

The column 140 may provide a mounting space 144 therein. The mounting space 144 may have a shape that extends vertically along the column 140. The inner side wall 141 of the column 140 may surround the mounting space 144. The mounting space 144 may be open toward the space 134 in the mount 130. The mounting space 144 may be open toward one side portion of the cartridge 200.

The PCB assembly 150 may be mounted in the mounting space 144. A plate 160 may cover the PCB assembly 150, and may be disposed in the mounting space 144. The window 170 may cover the PCB assembly 150 and the mounting space 144. The PCB assembly 150, the plate 160, and the window 170 may be sequentially stacked. The mounting space 144 may be referred to as an assembly accommodation space 144.

The PCB assembly 150 may include at least one of a printed circuit board (PCB) 151, a light source 153, or a first sensor 154. The light source 153 may be mounted on the PCB 151. At least one light source 153 may be provided. The first sensor 154 may be mounted on the PCB. The light source 153 and the first sensor 154 may be mounted at different positions on a single PCB. The first sensor 154 may be mounted in a region avoiding the at least one light source 153.

The PCB assembly 150 may be disposed inside the column 140 so as to face the cartridge 200. The PCB assembly 150 may face the first container 210, which is provided with the first chamber C1 and the insertion space 214. The PCB assembly 150 may be elongated vertically along the column 140. A connector 152 for electrical connection may be formed at one end of the PCB assembly 150.

The PCB 151 may be elongated vertically along the column 140. The PCB 151 may be a flexible printed circuit board (FPCB). The connector 152 may be formed at one end of the PCB 151. A plurality of light sources 153 may be arranged on the PCB 151. The first sensor 154 may be located at the center of the PCB 151. The first sensor 154 may be located between the light sources 153, and at least one light source 153 may be disposed on each side of the first sensor 154. The plurality of light sources 153 may be arranged vertically along the PCB 151. The plurality of light sources 153 may be arranged in the longitudinal direction of the column 140. The first sensor 154 may be disposed so as to face the insertion space 214. The light sources 153 may be disposed so as to face the outside of the insertion space 214. The light sources 153 may emit light toward the outside of the insertion space 214 so that the light is provided to the first chamber C1. The light sources 153 may be LEDs.

Accordingly, the light sources 153 may provide uniform light to the first chamber C1.

In addition, it is possible to prevent the paths of light provided by the light sources 153 from being blocked by the stick 400 inserted into the insertion space 214.

The first sensor 154 may be elongated vertically along the PCB 151. The first sensor 154 may be elongated along the first container 210 or the insertion space 214. The first sensor 154 may face the insertion space 214. The first sensor 154 may sense information about the cartridge 200. For example, the first sensor 154 may sense at least one of information about a change in the remaining amount of liquid stored in the first chamber C1 in the cartridge 200, information about the type of liquid stored in the first chamber C1 in the cartridge 200, information about whether the stick 400 is inserted into the insertion space 214 in the cartridge 200, information about the type of stick 400 inserted into the insertion space 214 in the cartridge 200, information about the extent of use or the availability of the stick 400 inserted into the insertion space 214 in the cartridge 200, information about whether the cartridge 200 having the stick 400 inserted into the insertion space 214 is coupled to the body 100, or information about the type of cartridge 200 coupled thereto. The information about the cartridge 200 is not limited to the aforementioned information.

The first sensor 154 may sense a change in the electromagnetic characteristics of the cartridge 200 to sense information about the cartridge 200. The first sensor 154 may sense a change in electromagnetic characteristics caused by a neighboring object. For example, the first sensor 154 may be a capacitance sensor. For example, the first sensor 154 may be a magnetic proximity sensor. The type of first sensor 154 is not limited thereto. For example, when the stick 400 is inserted into the insertion space 214 in the cartridge 200 or when there is a change in the volume of the liquid stored in the first chamber C1, the electromagnetic characteristics sensed by the first sensor 154 may change, and the first sensor 154 may measure the change to sense information about the cartridge 200.

The window 170 may be coupled to the column 140. The window 170 may be formed of a transparent material. The window 170 may allow light to pass therethrough. The window 170 may be coupled to the column 140 to cover the PCB assembly 150 (refer to FIG. 26). The window 170 may have a shape that extends vertically along the column 140. The window 170 may be disposed between the column 140 and the cartridge 200. The window 170 may be disposed adjacent to the inner side wall 141 of the column 140. The window 170 may cover one side portion of the cartridge 200. The window 170 may face the side portion of the cartridge 200. The window 170 may be formed to be thin so that the PCB assembly 150 is adjacent to the cartridge 200.

One surface 171*a* of the window 170 may be in contact with the side portion of the cartridge 200 to support the cartridge 200 (refer to FIGS. 4 to 6). The opposite surface 171*b* of the window 170 may be in close contact with the PCB assembly 150 (refer to FIG. 27). The surface 171*a* of the window 170 may be referred to as the front surface of the window 170. The opposite surface 171*b* of the window 170 may be referred to as the rear surface of the window 170.

The surface 171*a* of the window 170 may have a shape corresponding to the outer wall 211 of the first container 210, which forms the circumference of the insertion space 214. The insertion space 214 may be adjacent to the column 140 and the PCB assembly 150 (refer to FIG. 15). The insertion space 214 may be located between the first chamber C1 and the column 140. The outer wall 211 of the first container 210, which surrounds the circumference of the insertion space 214, may have a round shape that extends along the circumference of the insertion space 214. The surface 171*a* of the window 170 may have a round shape that surrounds the outer side of the insertion space 214. The surface 171*a* of the window 170 may have a round shape that surrounds the outer wall 211 of the first container 210, which forms the circumference of the insertion space 214. The surface 171*a* of the window 170 may have a shape that is concave in the direction opposite the cartridge 200. The surface 171*a* of the window 170 may support one side wall of the cartridge 200. At least one recess 174, in which the light source 153 is accommodated, may be formed in the opposite surface 171*b* of the window 170. The recess 174 may be referred to as a light source recess 174 or a window recess 174. The light source recess 174 may be recessed toward the surface 171*a* from the opposite surface 171*b* of the window 170. Each of the plurality of light source recesses 174 may accommodate and cover a respective one of the plurality of light sources 153. Each of the plurality of light source recesses 174 may be formed at a position corresponding to the position of a respective one of the plurality of light sources 153. The plurality of light source recesses 174 may be arranged vertically. The first sensor 154 may be located between the plurality of light source recesses 174, and at least one light source recess 174 may be disposed on each side of the first sensor 154.

The opposite surface 171*b* of the window 170 may include a planar portion 172, which is formed to be flat. The planar portion 172 may be in close contact with the PCB assembly 150. The planar portion 172 may be inserted into the mounting space 144 in the column 140 (refer to FIG. 24). The light source recess 174 may be formed by depressing the planar portion 172.

The PCB assembly 150 may have a plurality of through-holes 151*a* formed therein. The through-holes 151*a* may be formed at one side of the PCB 151. The through-holes 151*a* may be formed in the upper portion of the PCB 151. The through-holes 151*a* may be located above the light source 153 and/or the first sensor 154. The through-holes 151*a* may be located on both sides of the PCB 151.

The window 170 may include a plurality of penetrating protrusions 172*a*. The penetrating protrusions 172*a* may protrude from the opposite surface 171*b* of the window 170. The penetrating protrusions 172*a* may be formed at positions corresponding to the through-holes 151*a*. The penetrating protrusions 172*a* may protrude toward the through-holes 151*a*. The penetrating protrusions 172*a* may pass through the through-holes 151*a*. A plurality of penetrating protrusions 172*a* may be provided. Each of the plurality of penetrating protrusions 172*a* may pass through a respective one of the plurality of through-holes 151*a*. The penetrating protrusions 172*a* may pass through the through-holes 151*a*, so the PCB assembly 150 and the window 170 may be disposed at the correct positions.

The window 170 may include a latching protrusion 173. The latching protrusion 173 may be formed on the opposite surface 171*b* of the window 170. The latching protrusion 173 may protrude from each side of the planar portion 172. The latching protrusion 173 may be provided in a plural number, and the plurality of latching protrusions 173 may be arranged in the vertical direction. Each of the plurality of latching protrusions 173 may have a shape that is elongated vertically so as to correspond to a side flange portion 1451.

The column 140 may include a flange 145. The flange 145 may be disposed inside the inner side wall 141 of the column 140. The flange 145 may protrude inwards from the inner side wall 141 of the column 140. The flange 145 may be integrally formed with the column 140. The flange 145 may protrude toward the inside of the column 140 to form an edge. The flange 145 may extend along the circumference of the assembly accommodation space 144. The flange 145 may have an open center, through which the assembly accommodation space 144 and the cartridge accommodation space 134 may be connected to each other.

The flange 145 may include at least one of a side flange portion 1451, a lower flange portion 1452, or an upper flange portion 1453. The flange 145 may be formed in a manner such that the side flange portion 1451, the lower flange portion 1452, and the upper flange portion 1453 are connected to each other. The side flange portion 1451 may have a shape that is elongated in the longitudinal direction of the column 140. The side flange portion 1451 may be provided in a pair, and the pair of side flange portions 1451 may be spaced apart from each other and may be formed on both sides of the column 140. The lower flange portion 1452 and the upper flange portion 1453 may be disposed between the pair of side flange portions 1451, and may be connected thereto. The side flange portions 1451, the lower flange portion 1452, and the upper flange portion 1453 may be connected to each other to form the periphery of the flange 145. The region surrounded by the side flange portions 1451, the lower flange portion 1452, and the upper flange portion 1453 may be open, so the assembly accommodation space 144 and the cartridge accommodation space 134 may communicate with each other.

The opposite surface 171*b* of the window 170 may be attached to the flange 145. The edge of the opposite surface of the window 170 may be attached to the flange 145. The opposite surface 171*b* of the window 170 may be attached to the flange 145 using an adhesive member. The adhesive member may be, for example, a sheet of tape or glue. The adhesive member is not limited thereto. The latching protrusions 173 may be engaged with the flange 145, so the window 170 may be coupled to the flange 145. The latching protrusions 173 may be engaged with the side flange portions 1451. The flange 145 may have a shape corresponding to the shape of the opposite surface 171*b* of the window 170, which is adjacent to the edge of the window 170. The lower flange portion 1452 and the upper flange portion 1453 may have a concave shape.

Accordingly, the PCB assembly 150 may be protected from the outside, and may be prevented from becoming separated.

In addition, light emitted from the PCB assembly 150 may be provided to the cartridge 200.

In addition, the window 170, the cartridge 200, and the PCB assembly 150 may be reliably coupled or fixed to each other.

The plate 160 may cover the region in the PCB assembly 150 that avoids the at least one light source 153. The plate 160 may be attached to the PCB assembly 150 to cover the first sensor 154. The plate 160 may allow an electromagnetic wave to pass therethrough. The plate 160, through which an electromagnetic wave passes, may not allow visible light to pass therethrough, or may be translucent.

Printed circuits, which are connected to the light sources 153, may be printed on the region in the PCB 151 that is adjacent to the light sources 153. The plate 160 may cover the printed circuits printed on the PCB 151 in the vicinity of the light sources 153. The plate 160 may have a shape that extends vertically along the first sensor 154 and extends further from the vertically extending portion thereof toward the printed circuits.

The plate 160 may expose the light sources 153, rather than covering the same. The light sources 153 may be disposed on both sides of the first sensor 154, with the first sensor 154 interposed therebetween, and may be arranged in the vertical direction. Portions of the plate 160 that correspond to the positions of the light sources 153 may be open. When the plate 160 is attached to the PCB assembly 150, the light sources 153 may be exposed through the open portions of the plate 160.

Accordingly, light emitted from the light sources 153 may not be blocked, and the first sensor 154 and/or the printed circuits printed on the PCB 151 may not be exposed to the outside, and may be protected from the outside.

In addition, the first sensor 154 may sense a change in the electromagnetic characteristics of the surroundings in the state of being covered by the plate 160.

Referring to FIG. 27, the PCB assembly 150 may be disposed inside the column 140, and may be elongated along the column 140. The PCB 151 may be elongated along the column 140. The connector 152, which is formed at one end of the PCB assembly 150, may be exposed downwards from the upper body 120. The connector 152 may be exposed downwards from the column 140. The connector 152 may be exposed downwards from the mount 130. The lower end of the column 140 may be open to form a gap 146. The connector 152 may be exposed downwards through the gap 146. The gap 146 may communicate with the mounting space 144 (FIG. 24).

The mount 130 may include the sensor accommodation portion 137. The sensor accommodation portion 137 may be formed in one side wall of the mount 130. The sensor accommodation portion 137 may provide a space 137*b* formed in the side wall of the mount 130 so as to be open downwards to accommodate the second sensor 180 inserted thereinto. The space 137*b* provided by the sensor accommodation portion 137 may be referred to as a sensor accommodation space 137*b*. The inner side surface of the sensor accommodation portion 137 may form a portion of the inner side surface 131 of the mount 130. The outer side surface of the sensor accommodation portion 137 may form a portion of the outer side surface 132 of the mount 130. The sensor accommodation portion 137 may be formed at a position opposite the column 140 with respect to the cartridge accommodation space 134. The column 140 may extend upwards from one side of the mount 130, and the sensor accommodation portion 137 may be formed at the opposite side of the mount 130.

The inner side surface 131 of the sensor accommodation portion 137 may be open to form a sensing hole 137*a*. The sensing hole 137*a* may be formed between the sensor accommodation space 137*b* and the cartridge accommodation space 134 to interconnect the sensor accommodation space 137*b* and the cartridge accommodation space 134. The sensing hole 137*a* may be adjacent to the cartridge inlet 224 (refer to FIG. 15). The sensing hole 137*a* may face the cartridge inlet 224.

The sensing hole 137*a* may be open in the lateral direction. The side portion of the second container 220 may be open to form the cartridge inlet 224, and the sensing hole 137*a*, which is open in the lateral direction, may face the cartridge inlet 224 (refer to FIG. 15).

Referring to FIGS. 28 and 29, the partition wall 112 of the lower body 110 may cover the upper side of the battery 190. The partition wall 112 may be disposed in the upper portion of the lower body 110 in a direction intersecting the side wall 111 of the lower body 110. The partition wall 112 may cover the upper sides of internal components of the lower body 110. The partition wall 112 may separate the space in which internal components of the lower body 110 are mounted from the space in which the upper body 120 is coupled. The partition wall 112 may be disposed below the upper body 120. The side wall 111 of the lower body 110 may extend upwards beyond the partition wall 112, and may surround the circumference of the partition wall 112. The inner circumferential surface of the side wall 111 of the lower body 110, which extends above the partition wall 112, may surround the circumference of the lower portion of the mount 130.

The second sensor 180 may be mounted on one side of the upper portion of the lower body 110. The second sensor 180 may be disposed on the partition wall 112. The second sensor 180 may be disposed at a position corresponding to the sensor accommodation portion 137 of the mount 130. The sensor support portion 185 may extend upwards from one side of the partition wall 112 to support the second sensor 180. The second sensor 180 may be disposed so as to face the lateral direction.

The upper body 120 may be coupled to the upper side of the lower body 110. The body latch 115 may be formed at the upper portion of the lower body 110. The body latch 115 may be formed at one end of the partition wall 112. The body latch 115 may have a protruding shape. The body latch 115 may be inserted into the fastening hole 135 in the mount 130, so the mount 130 and the lower body 110 may be coupled to each other.

The body rib 116 may have a shape that protrudes from the inner circumferential surface of the side wall 111 of the lower body 110. The body rib 116 may have a shape that extends along the inner circumferential surface of the side wall 111 of the lower body 110. The body rib 116 may be made of an elastic material. For example, the body rib 116 may be made of a material such as rubber or silicon. The body rib 116 may be disposed above the partition wall 112. The body rib 116 may be inserted into and be in close contact with the rib groove 136 in the mount 130.

The second fixing portion 118 may be disposed in the upper portion of the lower body 110. The second fixing portion 118 may be formed at a position corresponding to the first fixing portion 138. The second fixing portion 118 may be formed near the partition wall 112. The second fixing portion 118 may have a shape that protrudes upwards or is recessed downwards. The second fixing portion 118 may be provided in a plural number. The second fixing portion 118 may be coupled to the first fixing portion 138 of the mount 130.

Accordingly, the upper body 120 may be coupled to the lower body 110.

In addition, the position of the mount 130 may be reliably fixed to the lower body 110, and the upper body 120 may be prevented from shaking relative to the lower body 110.

The bottom 133 of the mount 130 may be open to form a connection terminal hole 133*a*. The connection terminal hole 133*a* may have a slit shape. The connection terminal hole 133*a* may be formed in a pair (refer to FIG. 27). A first connection terminal 191 may be formed so as to protrude upwards from the partition wall 112. The first connection terminal 191 may be provided in a pair. The first connection terminal 191 and the connection terminal hole 133*a* may be formed at positions corresponding to each other. When the upper body 120 is coupled to the lower body 110, the first connection terminal 191 may pass through the connection terminal hole 133*a*, and may be exposed to the cartridge accommodation space 134. When the second cartridge 200 is coupled to the upper body 120, the heater 262 (refer to FIG. 15) may come into contact with the first connection terminal 191, and may be electrically connected to at least one of devices such as the battery 190 and the control device 193. The devices that are electrically connected to the heater are not limited thereto.

The PCB assembly 150 may be electrically connected to a device provided in the lower body 110 via the connector 152, which is exposed downwards from the upper body 120. One side of the partition wall 112 may be open to form a connector insertion hole 117. The connector insertion hole 117 may be formed at a position corresponding to the column 140. The connector insertion hole 117 may be open upwards. A connection terminal 192 may be located below the connector insertion hole 117 inside the lower body 110. When the upper body 120 is coupled to the lower body 110, the connector 152 may be inserted into the connector insertion hole 117, and may come into contact with the second connection terminal 192. When the connector 152 comes into contact with the second connection terminal 192, the PCB assembly 150 may be electrically connected to at least one of devices such as the battery 190 and the control device 193 via the connector 152. The devices that are electrically connected to the PCB assembly are not limited thereto.

When the upper body 120 is coupled to the lower body 110, the second sensor 180 may be inserted into the space 137*b* provided by the sensor accommodation portion 137. The sensor accommodation portion 137 may surround the second sensor 180. When the mount 130 is coupled to the lower body 110, the second sensor 180 may be inserted upwards from the lower side of the sensor accommodation space 137*b*. The sensing hole 137*a*, which is formed at the sensor accommodation portion 137, may be open toward the cartridge 200. The second sensor 180 may face the sensing hole 137*a* inside the sensor accommodation portion 137. The second sensor 180 may be disposed so as to face the cartridge inlet 224 (refer to FIG. 15) inside the sensor accommodation portion 137. The second sensor 180 may sense the flow of air around the sensing hole 137*a*.

Referring to FIG. 30, the aforementioned stick 400 may include a medium portion 410. The stick 400 may include a cooling portion 420. The stick 400 may include a filter portion 430. The cooling portion 420 may be disposed between the medium portion 410 and the filter portion 430. The stick 400 may include a wrapper 440. The wrapper 440 may wrap the medium portion 410. The wrapper 440 may wrap the cooling portion 420. The wrapper 440 may wrap the filter portion 430. The stick 400 may have a cylindrical shape.

The medium portion 410 may include a medium 411. The medium portion 410 may include a first medium cover 413. The medium portion 410 may include a second medium cover 415. The medium 411 may be disposed between the first medium cover 413 and the second medium cover 415. The first medium cover 413 may be disposed at one end of the stick 400. The medium portion 410 may have a length of 24 mm.

The medium 411 may contain a multicomponent substance. The substance contained in the medium may be a multicomponent flavoring substance. The medium 411 may be composed of a plurality of granules. Each of the plurality of granules may have a size of 0.4 mm to 1.12 mm. The granules may account for approximately 70% of the volume of the medium 411. The length L2 of the medium 411 may be 10 mm. The first medium cover 413 may be made of an acetate material. The second medium cover 415 may be made of an acetate material. The first medium cover 413 may be made of a paper material. The second medium cover 415 may be made of a paper material. At least one of the first medium cover 413 or the second medium cover 415 may be made of a paper material, and may be crumpled so as to be wrinkled, and a plurality of gaps may be formed between the wrinkles so that air flows therethrough. Each of the gaps may be smaller than each of the granules of the medium 411. The length L1 of the first medium cover 413 may be shorter than the length L2 of the medium 411. The length L3 of the second medium cover 415 may be shorter than the length L2 of the medium 411. The length L1 of the first medium cover 413 may be 7 mm. The length L2 of the second medium cover 415 may be 7 mm.

Accordingly, each of the granules of the medium 411 may be prevented from being separated from the medium portion 410 and the stick 400.

The cooling portion 420 may have a cylindrical shape. The cooling portion 420 may have a hollow shape. The cooling portion 420 may be disposed between the medium portion 410 and the filter portion 430. The cooling portion 420 may be disposed between the second medium cover 415 and the filter portion 430. The cooling portion 420 may be formed in the shape of a tube that surrounds a cooling path 424 formed therein. The cooling portion 420 may be thicker than the wrapper 440. The cooling portion 420 may be made of a paper material thicker than that of the wrapper 440. The length L4 of the cooling portion 420 may be equal or similar to the length L2 of the medium 411. The length L4 of each of the cooling portion 420 and the cooling path 424 may be 10 mm. When the stick 400 is inserted into the aerosol-generating device (refer to FIG. 3), at least part of the cooling portion 420 may be exposed to the outside of the aerosol-generating device.

Accordingly, the cooling portion 420 may support the medium portion 410 and the filter portion 430, and may secure the rigidity of the stick 400. In addition, the cooling portion 420 may support the wrapper 440 between the medium portion 410 and the filter portion 430, and may provide a portion to which the wrapper 440 is adhered. In addition, the heated air and aerosol may be cooled while passing through the cooling path 424 in the cooling portion 420.

The filter portion 430 may be composed of a filter made of an acetate material. The filter portion 430 may be disposed at the other end of the stick 400. When the stick 400 is inserted into the aerosol-generating device (refer to FIG. 3), the filter portion 430 may be exposed to the outside of the aerosol-generating device. The user may inhale air in the state of holding the filter portion 430 in the mouth. The length L5 of the filter portion 430 may be 14 mm.

The wrapper 440 may wrap or surround the medium portion 410, the cooling portion 420, and the filter portion 430. The wrapper 440 may form the external appearance of the stick 400. The wrapper 440 may be made of a paper material. An adhesive portion 441 may be formed along one edge of the wrapper 440. The wrapper 440 may surround the medium portion 410, the cooling portion 420, and the filter portion 430, and the adhesive portion 441 formed along one edge of the wrapper 440 and the other edge thereof may be adhered to each other. The wrapper 440 may surround the medium portion 410, the cooling portion 420, and the filter portion 430, but may not cover one end or the other end of the stick 400.

Accordingly, the wrapper 440 may fix the medium portion 410, the cooling portion 420, and the filter portion 430, and may prevent these components from being separated from the stick 400.

A first thin film 443 may be disposed at a position corresponding to the first medium cover 413. The first thin film 443 may be disposed between the wrapper 440 and the first medium cover 413, or may be disposed outside the wrapper 440. The first thin film 443 may surround the first medium cover 413. The first thin film 443 may be made of a metal material. The first thin film 443 may be made of an aluminum material. The first thin film 443 may be in close contact with the wrapper 440, or may be coated thereon.

A second thin film 445 may be disposed at a position corresponding to the second medium cover 415. The second thin film 445 may be disposed between the wrapper 440 and the second medium cover 415, or may be disposed outside the wrapper 440. The second thin film 445 may be made of a metal material. The second thin film 445 may be made of an aluminum material. The second thin film 445 may be in close contact with the wrapper 440, or may be coated thereon.

Accordingly, when a capacitance sensor for recognizing the stick is inserted in the aerosol-generating device, the capacitance sensor may sense whether the stick 400 is inserted into the aerosol-generating device.

Referring to FIGS. 1 to 30, an aerosol-generating device in accordance with one aspect of the present disclosure may include a body 100, a cartridge 200, which is coupled to the body 100, comprises a first chamber C1 configured to store liquid and an insertion space 214 formed separately from the first chamber C1, the insertion space 214 has opening to an outside, and a cover 310 configured to move between an open position and a closed position to open and close the insertion space 214. The cartridge 200 may include a cover recess 215, which is formed adjacent to the opening of the insertion space, and is recessed outward from the insertion space 214. the cover 310 may be located in the cover recess 215 when the cover 310 is in the open position.

In addition, in accordance with another aspect of the present disclosure, the cartridge 200 may further include a second chamber C2 in communication with the insertion space 214, a wick 261, which is disposed in the second chamber C2 and in communication with the first chamber C1, and a heater 262 configured to heat the wick 261.

In addition, in accordance with another aspect of the present disclosure, the cover recess 215 may be formed in a manner such that an inner wall 212 between the first chamber C1 and the insertion space 214 is recessed toward the first chamber C1.

In addition, in accordance with another aspect of the present disclosure, when the cover 310 is located in the cover recess 215, the cover 310 may be parallel to the interior surface of the insertion space 214 located adjacent to the cover recess 215.

In addition, in accordance with another aspect of the present disclosure, the cartridge 200 may include a first guide 216 inclined from the bottom of the cover recess 215 toward the lower side of the insertion space 214.

In addition, in accordance with another aspect of the present disclosure, the first guide 216 may extend in a circumferential direction along at least a portion of the circumference of the insertion space 214.

In addition, in accordance with another aspect of the present disclosure, when the cover 310 is located in the cover recess 215, the first guide 216 may be adjacent to one end of the cover 310.

In addition, in accordance with another aspect of the present disclosure, the cover 310 may be pivotably mounted at a position adjacent to the opening of the insertion space 214. The cover 310 may be pivoted toward the inside of the insertion space 214 to move from the closed position to the open position, and may be pivoted away from the inside of the insertion space 214 to move from the open position to the closed position.

In addition, in accordance with another aspect of the present disclosure, the aerosol-generating device may further include a spring 312 configured to provide elastic force so that the cover 310 is biased toward the closed position.

In addition, in accordance with another aspect of the present disclosure, the aerosol-generating device may further include a cap 300, which is configured to cover the cartridge 200 and comprises an insertion hole 304 corresponding to the opening of the insertion space 214. The cover 310 may be mounted to the cap 300.

In addition, in accordance with another aspect of the present disclosure, the cap 300 may include a second guide 306, which is disposed below the insertion hole 304 and inclined from a portion near the insertion hole 304 toward the insertion space 214.

In addition, in accordance with another aspect of the present disclosure, the second guide 306 may be disposed opposite a pivot shaft of the cover 310 with respect to the insertion hole 304.

In addition, in accordance with another aspect of the present disclosure, the second guide 306 may extend adjacent to the pivoting radius of the cover 310.

In addition, in accordance with another aspect of the present disclosure, one end of the second guide 306 may be located nearer to the insertion hole 304 radially extend further outwards than an interior surface of the insertion hole 304, and the opposite end of the second guide 306 radially located distal to the insertion hole may be adjacent to the interior surface of the insertion space 214.

In addition, in accordance with another aspect of the present disclosure, the cover 310 may be disposed below the insertion hole 304 in the cap 300, and the cap 300 may include an insertion hole wall 305 forming the circumference of the insertion hole 304 in the cap 300. When the cover 310 is in closed position, the cover may contact the insertion hole wall 305 such that movement of the cover 310 is restricted.

In addition, in accordance with another aspect of the present disclosure, the cap 300 may include an insertion hole wall 305, which forms the circumference of the insertion hole 304 in the cap 300 and has a round inner circumferential surface.

In addition, in accordance with another aspect of the present disclosure, the cartridge 200 may include a stick stopper 217 protruding inwards from the interior surface of the insertion space 214 at a position adjacent to the opposite end of the insertion space 214 from the opening.

In addition, in accordance with another aspect of the present disclosure, the the plurality of stick stoppers 217 may be arranged along the circumference of the insertion space 214.

In addition, in accordance with another aspect of the present disclosure, the body 100 may include a lower body 110 and an upper body 120, which is disposed above the lower body 110 and is configured to allow the cartridge 200 to be coupled thereto. The upper body 120 may include a mount 130 which configured to receive the lower portion of the cartridge 200, and a column 140, which extends upwards and positioned to be adjacent to one side wall of the cartridge 200.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An aerosol-generating device comprising:

a body;

a cartridge coupled to the body, the cartridge comprising a first chamber configured to store a liquid, an inner wall, and an insertion space partitioned from the first chamber by the inner wall and having an opening to an outside; and a cover configured to move between an open position and a closed position to open and close the insertion space, wherein the cartridge comprises:

a cover recess formed adjacent to the opening of the insertion space, wherein the cover recess is recessed outward from the insertion space, wherein the cover recess is formed in a manner such that the inner wall is recessed toward the first chamber, wherein the cover is located in the cover recess when the cover is in the open position.

2. The aerosol-generating device according to claim 1, wherein the cartridge further comprises:

a second chamber in communication with the insertion space;

a wick mounted in the second chamber and in communication with the first chamber; and a heater configured to heat the wick.

3. The aerosol-generating device according to claim 2, wherein when the cover is located in the cover recess, the cover is parallel to an interior surface of the insertion space located adjacent to the cover recess.

4. The aerosol-generating device according to claim 1, wherein the cartridge comprises a first guide inclined from a bottom of the cover recess toward a lower side of the insertion space.

5. The aerosol-generating device according to claim 4, wherein the first guide extends in a circumferential direction along at least a portion of a circumference of the insertion space.

6. The aerosol-generating device according to claim 4, wherein, when the cover is located in the cover recess, the first guide is adjacent to one end of the cover.

7. The aerosol-generating device according to claim 1, wherein the cover is pivotably mounted at a position adjacent to the opening of the insertion space, and wherein the cover is pivoted toward an inside of the insertion space to move from the closed position to the open position, and is pivoted away from the inside of the insertion space to move from the open position to the closed position.

8. The aerosol-generating device according to claim 1, further comprising:

a spring configured to provide elastic force so that the cover is biased toward the closed position.

9. The aerosol-generating device according to claim 7, further comprising:

a cap configured to cover the cartridge and comprising an insertion hole corresponding to the opening of the insertion space, wherein the cover is mounted to the cap.

10. The aerosol-generating device according to claim 9, wherein the cap comprises a second guide disposed below the insertion hole and inclined from a portion adjacent to the insertion hole toward the insertion space.

11. The aerosol-generating device according to claim 10, wherein the second guide is disposed opposite a pivot shaft of the cover with respect to the insertion hole.

12. The aerosol-generating device according to claim 11, wherein the second guide extends adjacent to a pivoting radius of the cover.

13. The aerosol-generating device according to claim 10, wherein one end of the second guide located nearer to the insertion hole radially extends further outwards than an interior surface of the insertion hole, and an opposite end of the second guide radially located distal to the insertion hole is adjacent to the interior surface of the insertion space.

14. The aerosol-generating device according to claim 9, wherein the cover is disposed below the insertion hole in the cap, wherein the cap comprises an insertion hole wall forming a circumference of the insertion hole in the cap, and wherein when the cover is in the closed position, the cover contacts the insertion hole wall such that movement of the cover is restricted.

15. The aerosol-generating device according to claim 9, wherein the cap comprises an insertion hole wall forming a circumference of the insertion hole in the cap, and the insertion hole wall has a round inner circumferential surface.

16. The aerosol-generating device according to claim 1, wherein the cartridge comprises a stick stopper protruding inwards from an interior surface of the insertion space at a position adjacent to an opposite end of the insertion space from the opening.

17. The aerosol-generating device according to claim 16, wherein a plurality of stick stoppers is arranged along a circumference of the interior surface of the insertion space.

18. The aerosol-generating device according to claim 1, wherein the body comprises:

a lower body; and an upper body disposed above the lower body and configured to allow the cartridge to be coupled thereto, and wherein the upper body comprises:

a mount configured to receive a lower portion of the cartridge; and a column extending upwards and positioned to be adjacent to one side wall of the cartridge.

19. The aerosol-generating device according to claim 1, further comprises a stick, wherein:

when the stick is inserted into the insertion space, the cover is pivoted toward an inside of the insertion space to move from the closed position to the open position; and when the stick is removed from the insertion space, the cover is pivoted away from the inside of the insertion space to move from the open position to the closed position.

* * * * *